US009353757B2

(12) United States Patent
Jones

(10) Patent No.: US 9,353,757 B2
(45) Date of Patent: May 31, 2016

(54) MAGNETICALLY ACTUATED FLUID PUMP

(76) Inventor: Brian Carter Jones, New Hartford, CT (US)

( * ) Notice: Subject to any disclaimer, the term of this patent is extended or adjusted under 35 U.S.C. 154(b) by 921 days.

(21) Appl. No.: 13/411,231

(22) Filed: Mar. 2, 2012

(65) Prior Publication Data

US 2012/0224987 A1 Sep. 6, 2012

Related U.S. Application Data

(60) Provisional application No. 61/448,722, filed on Mar. 3, 2011.

(51) Int. Cl.

| | |
|---|---|
| ***F04B 9/00*** | (2006.01) |
| ***F04D 25/06*** | (2006.01) |
| ***F04B 15/00*** | (2006.01) |
| ***F04B 17/04*** | (2006.01) |
| ***F04B 23/10*** | (2006.01) |
| ***F04B 49/22*** | (2006.01) |
| ***F04D 27/00*** | (2006.01) |

(52) U.S. Cl.

CPC . *F04D 25/06* (2013.01); *F04B 9/00* (2013.01); *F04B 15/00* (2013.01); *F04B 17/04* (2013.01); *F04B 17/042* (2013.01); *F04B 23/10* (2013.01); *F04B 49/22* (2013.01); *F04D 27/009* (2013.01)

(58) Field of Classification Search

CPC ..... F04B 9/00; F04B 15/00; F04B 23/10; F04B 17/04; F04B 17/042; F04B 49/22; B01D 19/00; F04D 25/06; F04D 27/009

USPC ..... 417/405, 420; 222/189.09; 95/46; 96/6; 55/385.4

See application file for complete search history.

(56) References Cited

U.S. PATENT DOCUMENTS

| | | | | |
|---|---|---|---|---|
| 1,775,759 | A * | 9/1930 | Grant | 417/405 |
| 4,011,477 | A | 3/1977 | Scholin | |
| 4,050,859 | A | 9/1977 | Vork | |
| 4,501,981 | A | 2/1985 | Hansen | |
| 4,671,745 | A | 6/1987 | Smith | |
| 4,795,318 | A | 1/1989 | Cusack | |
| 4,850,821 | A | 7/1989 | Sakai | |
| 5,472,323 | A | 12/1995 | Hirabayashi et al. | |
| 5,749,942 | A * | 5/1998 | Mattis | B01D 19/0031 95/46 |

(Continued)

FOREIGN PATENT DOCUMENTS

JP 2008006393 A * 1/2008

OTHER PUBLICATIONS

International Search Report & Written Opinion PCT/US2012/053913; Nov. 7, 2012.

*Primary Examiner* — Devon Kramer
*Assistant Examiner* — Philip Stimpert
(74) *Attorney, Agent, or Firm* — Tarolli, Sundheim, Covell & Tummino LLP

(57) ABSTRACT

An integrated fluid management system is provided with capability to deliver precise flow rate and fluid dosing capability over a wide range of operator set parameters. A magnetically actuated pump head is low cost, affords simple installation, and may be disposable. Multiple pump heads may be docked to a single drive module or control module to provide concurrent metering of multiple fluids and to maintain precise volume ratio of the multiple fluids to one another. The magnetic pump head may be integrated with radio frequency Identification devices (RFID) and Hall Effect Sensors to provide customized control and fail safe operation.

15 Claims, 10 Drawing Sheets

(56) References Cited

U.S. PATENT DOCUMENTS

| | | | | |
|---|---|---|---|---|
| 5,899,673 | A | 5/1999 | Bosley et al. | |
| 7,288,085 | B2 | 10/2007 | Olsen | |
| 7,477,052 | B2 | 1/2009 | Schmidt | |
| 2004/0191093 | A1 | 9/2004 | Weigl | |
| 2006/0043101 | A1* | 3/2006 | Bhimani et al. | 222/1 |
| 2007/0131711 | A1 | 6/2007 | Minard et al. | |
| 2007/0210659 | A1* | 9/2007 | Long | 310/80 |
| 2008/0315728 | A1 | 12/2008 | Liu et al. | |
| 2010/1089572 | | 7/2010 | Hansen | |

* cited by examiner

MAGNETICALLY ACTUATED FLUID PUMP

RELATED APPLICATIONS

This application claims priority from U.S. Provisional Application Ser. No. 61/448,722, filed Mar. 3, 2011, the subject matter of which is incorporated herein in its entirety.

TECHNICAL FIELD

The present invention relates generally to pumps and valves and, in particular, to a magnetically driven piston pump and a magnetically driven flow control valve.

BACKGROUND ART

Precision fluid metering is demanded in many industries. A common denominator is the need to meter or dose working fluids at flow rates generally less than 10 liters per hour, sometimes referred to as the "micro flow" range. End users frequently require very high accuracy fluid delivery provided at a low cost. High accuracy is synergistic with the continual advancement of digital technologies that make it possible to achieve more precise control of electric motors and solenoids. Information transfer using wireless technology, WIFI Internet, radio frequency identification tags, bar codes, etc., are also pushing system developers to offer more customized user interfaces that demand increased fluid delivery or dose precision.

Typical market segments and applications may include: medical diagnostics, medical fluids delivery, food dosing/packaging, beverage equipment, industrial dosing, paint and ink dosing, fuel cells, water analysis, semi-conductor electronics, chemical/gas analyzers, cleaning and disinfectant dosing.

Working fluids are as diverse as their respective applications and may include liquids and gases such as water, IV drugs and solutions, food and beverage concentrates, soaps and detergents, dyes, and analysis chemicals to name a few. Precise adjustment of flow rate is often required between as little as 1.0 ml/hr to as high as 10,000 ml/hr. Delivered fluid pressures are generally very close to atmospheric pressure, but may range upward to 15-30+ pounds per square inch (103-206+ kilopascal) in some applications.

Precision fluid metering solutions often fall into three (3) general categories. One category employs a variable speed pump, electronic flow meter and a closed loop feedback controller. The controller makes incremental adjustments to the pump speed to correct for flow rate deviations from a predefined set point. A second category may involve using constant speed pump, and applying an electronically actuated, variable orifice downstream of the pump. The controller makes incremental adjustments based the measured flow rate, but instead of adjusting pump speed, opens or closes the variable orifice to throttle the flow rate and maintain the flow at pre-defined set point. A third category applies open loop control using a variable speed pump that is powered using continuous or pulse width modulated DC supply voltage. Open loop control may be used where there is a known relationship between the DC supply voltage, pump speed, and the volumetric displacement rate of the pump. Open loop control is desirable because it is generally simpler to operate, has fewer components and is lower in cost.

However, the flow accuracy of open loop control is limited by the volumetric displacement accuracy of the pump and accuracy of the pump motor speed. Each pump type provides its own set of features and benefits that include trade-off in size, cost, power, material compatibility, reliability, and flow accuracy. There is generally a large trade-off between cost and accuracy. For example syringe pumps with precise stroke and volumetric precision may be used to deliver intravenous drugs and solutions with exceptional dose accuracy, but they are very expensive and not convenient to use. On the other hand, peristaltic pumps provide good value and are easy to use. However peristaltic pumps offer greatly reduced accuracy as compared to syringe pumps due to inconsistent tubing elasticity that may result in variable fluid delivery rate.

Each market application has its own set of demands and challenges. Some markets are also beginning to consider a new demand-disposability of the wetted pump components. Precision disposable pumps are of keen interest in the medical market where it is cost prohibitive to clean and sterilize recyclable components after contact with medical fluid media. While the tubing set of a peristaltic pump is disposable, it cannot deliver acceptable dose accuracy, especially in the lower micro flow range. Disposable medical applications may include but are not limited to drug delivery, IV solutions, peritoneal dialysis, hemodialysis, and anesthesia delivery. Disposable pumps may also be attractive in other markets, for example integration with disposable fluid containers such as the "bag-in-box" used in the food, beverage, and personal care products industries. The beverage market provides an added challenge wherein a precise amount of concentrate must be continuously mixed with flowing water to maintain an accurate volume ratio of water-to-concentrate for good beverage quality and customer satisfaction. A major difficulty is caused by the fact that water flow rate may vary widely due to variation in water supply pressure. However, a general theme across all markets is that customers increasingly demand high accuracy, ease of use, and reliability, all provided with a low cost.

Positive displacement pumps, such as diaphragm pumps or more preferably piston pumps, may offer precision dosing as long as a suitable control system is employed to trigger precisely timed linear, cyclic movements that drive the diaphragm or piston, respectively. In general the piston pump is more suitable for low dose and/or low flow rate because the stroke volume can be scaled down by reducing the diameter and stroke of the piston. Also the stroke volume of a piston pump is precise as compared to a diaphragm pump. Diaphragms being made from flexible elastomers may cause the stroke volume to vary with changes in the stoke speed, fluid viscosity and pressure rise across the pump. Conventional diaphragm and piston pumps are not considered disposable because the pump cost is too high for one time use. The most expensive component of the pump is the drive motor assembly. Recovery of the drive motor assembly from the pump head is cost prohibitive due to the high amount of labor needed to remove the motor from the pump head, and then reassemble and re-qualify a new pump head with the recycled drive motor assembly.

Many micro dosing fluid delivery applications involve liquids that are stored in a plastic bag at atmospheric pressure. Such bags are equipped with fittings that allow for a tube to connect the liquid contents of the bag to the inlet port of the fluid delivery pump. Examples are the common "bag-in-box" containers used in the beverage industry to store drink products and beverage concentrates. "IV bags" are also used to store intravenous solutions and drugs in the medical field. Of concern is the infiltration of air into the pump inlet or suction tube when the bag becomes depleted and must be disconnected from the tubing to install a new, replenished bag of liquid. Air bubbles pulled into the pump suction and then delivered into the pump discharge tube is problematic. In beverage applications this may result in poor delivered drink quality. In medical applications air delivered with IV fluids may be harmful to the patient under some conditions.

SUMMARY OF INVENTION

The present invention provides a new and improved magnet-based drive method and system which may form part of a pump, control valve or other device. According to one embodiment, the apparatus includes a shaft which is operative to rotate at least one drive magnet. An actuating piston head sub-assembly includes a driven magnet that is carried by a carriage with part of the carriage forming a piston that is reciprocally, linearly movable in a piston housing. The piston is movable between two positions. A drive module housing includes structure for receiving the piston head and is arranged such that the driven magnet is located in proximity to the drive magnet so as to create alternating attracting and repelling force between the drive and driven magnets as the drive magnet is rotated about the axis of the shaft. As the shaft is rotated, the carriage moves to one extreme position when the drive magnet is in one predetermined position and moves to its other extreme position when the drive magnet rotates to another predetermined position. In one embodiment, this magnetic-based apparatus serves as a pump assembly and includes a pump head in which the piston head is reciprocally mounted, such that when it reciprocates, it pumps fluid from an inlet to an outlet in cooperation with inlet and outlet check valves.

According to this embodiment, the shaft, which is operative to rotate the drive magnet, may be rotated by an electric motor or a fluid-driven turbine.

In another embodiment, the magnetic-based drive apparatus forms part of a shut-off type control valve. In this latter embodiment, the piston carries a seal. The seal carried by the piston is movable between a fluid blocking position which blocks flow through a passage and a spaced position which allows fluid flow through the passage. According to this embodiment, the drive magnet may be rotated in one direction to move the piston assembly into the blocking position and may reverse rotate, due to magnet repulsion, in order to allow the piston to move to the spaced position.

According to another feature of the invention, an air bleed accumulator may form part of the apparatus and functions to remove air from fluid being delivered to the inlet of a pump head. The accumulator includes a chamber for receiving fluid, a dip tube through which fluid is delivered to an inlet port and a membrane and check valve which are operative to bleed air from the accumulator chamber so that it does not enter the fluid stream entering the pump inlet.

According to another embodiment, the drive magnet may be rotated by a fluid-driven turbine. In this disclosed application, the pumping apparatus serves as a ratio pump and can be used to mix two fluids, one fluid being used to drive the turbine, whereas the other fluid is pumped by the pumping apparatus. This ratio pump may form part of a fluid dispensing system, such as a beverage dispenser. In the case of a beverage dispenser, the ratio pump can be used to mix beverage syrup with carbonated water.

In order to provide additional precision for pumping applications, the positions of the drive and/or driven magnets may be monitored by a sensor, such as a Hall Effect Sensor. The sensors are used to determine the positions of the associated magnet and the frequency with which the magnets are moving. When used in a pumping application, the extent of motion of the piston assembly determines the volume being pumped. Thus, knowing the stroke frequency of the piston assembly, as sensed by the sensor, can be used to precisely determine the volume of fluid pumped.

The invention also contemplates incorporating an RFID device in the housing in which the piston assembly is supported so that data can be transferred to an associated drive or control module.

A control module is also disclosed in which a drive module is located. The drive module is designed to accept a pump head such that when the pump head is installed, an associated driven magnet in the pump head is located in proximity to a drive magnet forming part of the drive module. The control module performs control functions on the drive module and, thus, controls the pumping function of the pump head.

According to the invention, a magnet pump is offered to provide the high accuracy of a closed loop feedback pump control system using a simple, feed forward control method. A pump head subassembly is self-contained, modular and magnetically coupled to a power source. It is capable of metering the flow rate of liquids, vapors and/or gases. The disclosures that follow are primarily focused on description of how the pump operates with incompressible liquids for simplicity. However, the pump may be applied with equal advantage processing vapors and/or gases.

The pump head is inherently of low cost construction, rendering it operationally and economically feasible to use the pump as a disposable product. While the pump head may be disposed after one use, its construction is durable enough for usage in permanent or semi-permanent applications. Should the pump head become worn out, it may be easily removed from a drive module and quickly replaced in a matter of seconds.

Another embodiment will be shown to offer unique benefit in the beverage market, wherein beverage concentrate is continuously adjusted or matched to the changing water flow rate in a very simple, reliable and yet cost effective manner as compared to presently available technology.

Yet another embodiment will be shown wherein the magnetic coupling mechanism applied to the magnet pump may be used to shut off flowing fluid in a valve application.

Additional features and a fuller understanding of the invention will become apparent in reading the following detailed description made in connection with the accompanying drawings.

DETAILED DESCRIPTION

Figure 1:
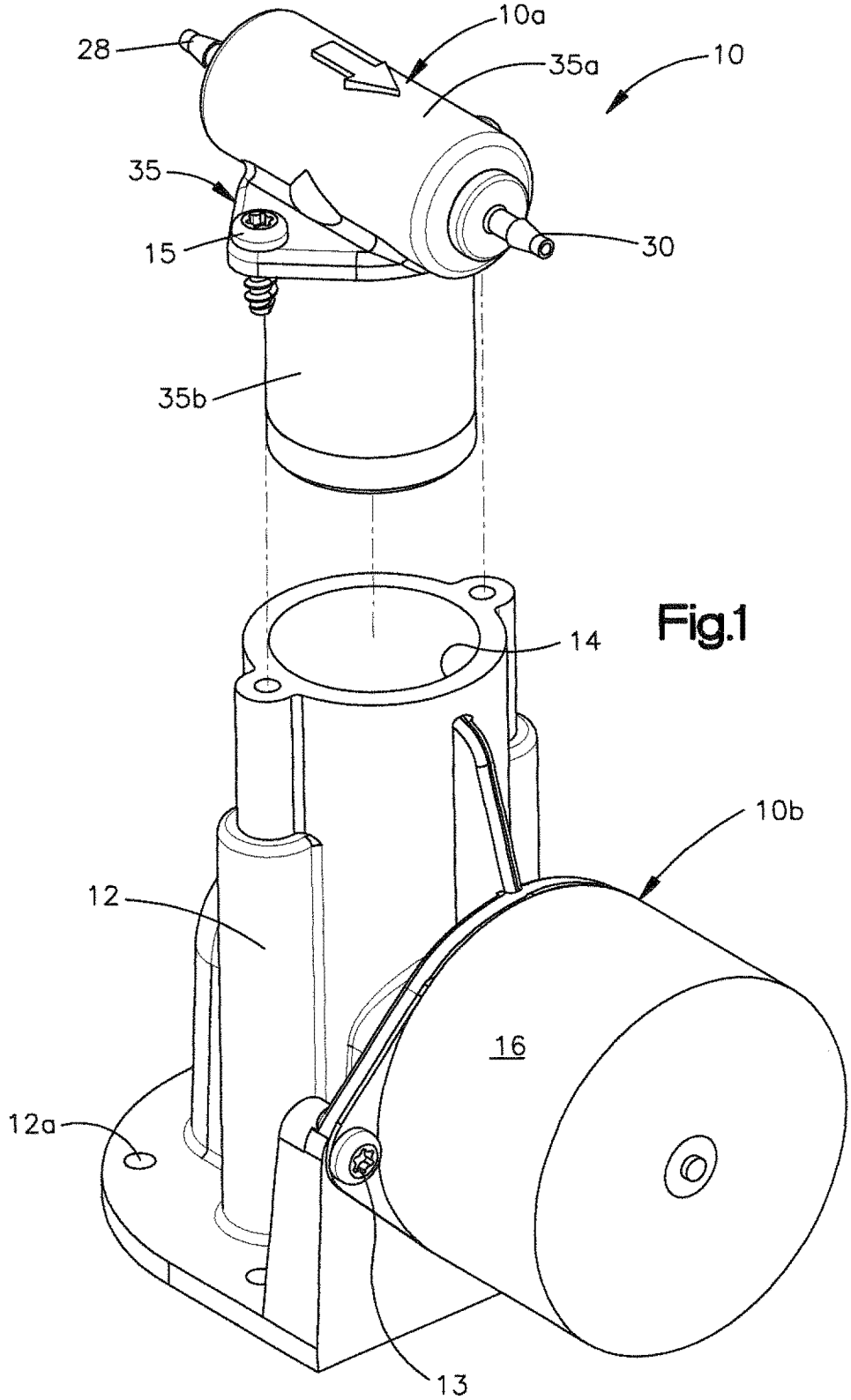
FIG. 1 is a perspective, partially exploded view of a pump assembly constructed in accordance with one embodiment of the invention.

FIG. 1 illustrates a pump assembly constructed in accordance with one preferred embodiment of the invention. The pump assembly 10 includes a pump head subassembly 10*a* and a pump motor drive module subassembly 10*b*. The disclosed pump assembly adapts the principles of operation of a diaphragm, piston or other pump type that requires reciprocating or cyclic linear drive motion into a device that allows for the wetted components (to be described) of the pump head subassembly 10*a* to be easily attached and detached from the motor drive module 10*b*. The pump head subassembly 10*a* is preferably self-contained and modular and, according to the invention, there is no need for mechanical or electric connections between the pump head assembly and the motor drive module subassembly, because these components are magnetically coupled. The pump head subassembly 10*a* includes a housing or body 35 which includes an upper body section 35*a* which houses check valves and flow passages to be described, as well as a lower body section 35*b* which houses a magnetically driven pumping element to be described. As seen best in FIG. 1, the lower body section 35*b* of the pump head 10*a* is received in a complementally-formed cavity 14 defined by the motor drive module 10*b*. The pump head subassembly 10*a* is secured to the motor drive module 10*b* by suitable fasteners 15.

Pump head subassemblies of different volumetric capacities may be universally adapted to the motor drive module 10*b*, thus extending the volumetric pumping range of the drive module subassembly 10*b*.

Unless otherwise noted in the foregoing detailed description, the pump and valve components are preferably fabricated from molded thermoplastic resins. There are many candidate resins that will satisfy the durability and reliability requirements including but not limited to various grades of acetals, nylons, polycarbonate/polyester blends, polysulfones, polyphenylene sulfides, and others. The thermoplastics may also be blended with PTFE Teflon additive to reduce friction between moving components. Inert fillers such as glass fibers and glass beads may also be compounded with the base resin to improve strength and dimensional accuracy of the molded pump components.

Figure 2:
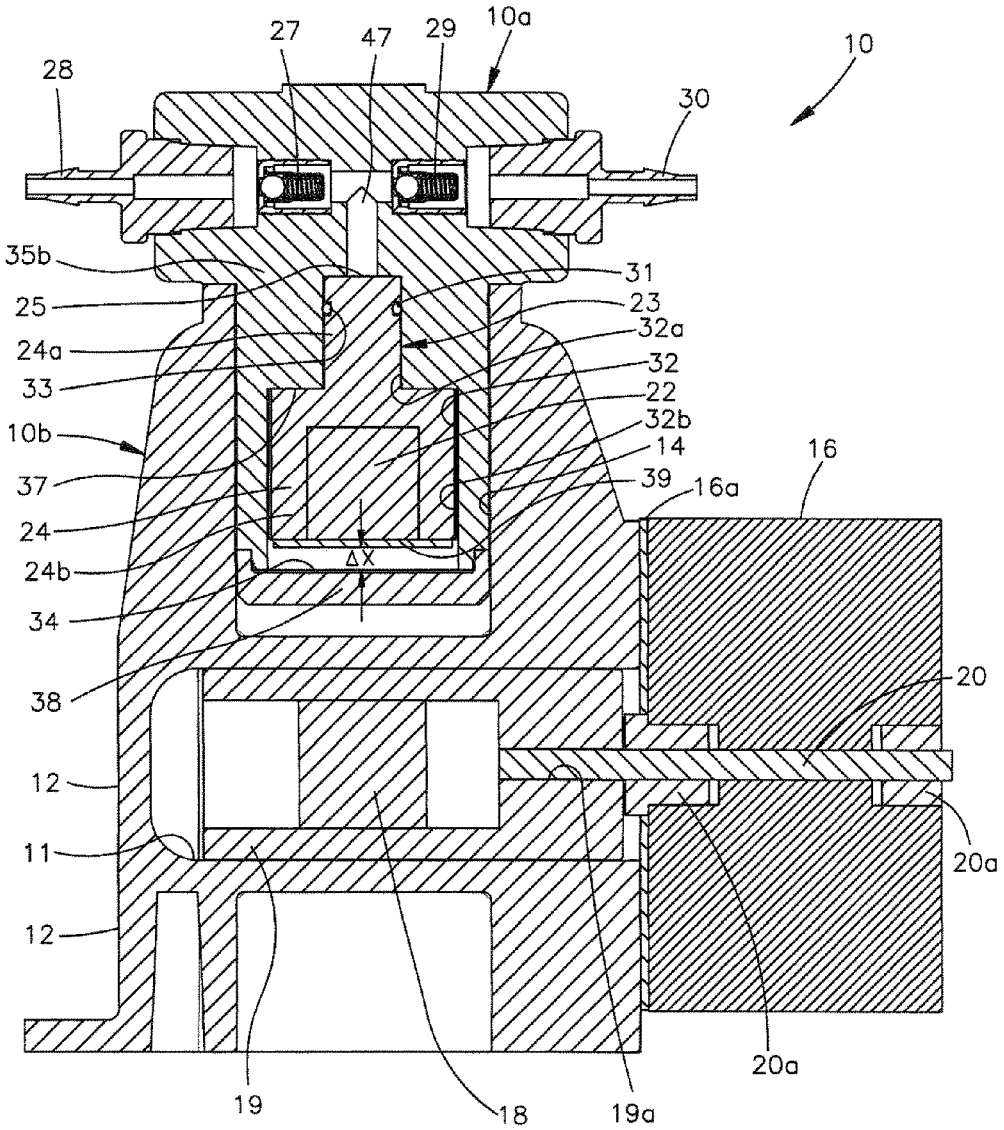
FIG. 2 is a sectional view of the pump assembly shown in FIG. 1.

The motor drive module 10*b* includes an actuator or drive motor 16 with constant or variable speed. Motor 16 may be selected as a stepper motor to provide a source of precision rotary motion that may be controlled in degree or even fractional degree rotational movement. However, other drive motor types such as variable speed DC motors or constant speed AC synchronous motors may be adapted depending on the pump application. A preferred embodiment of the pump assembly 10 applied as a piston pump is shown in FIG. 2 which is a sectional view of FIG. 1. The motor 16 is fastened to a motor mounting plate 16*a* by means of fasteners not shown. Motor plate 16*a* is in turn is fastened to a drive module housing 12 of the motor drive module 10*b* by means of fasteners 13. A cylindrically or cubically shaped, radially magnetized, bi-polar permanent magnet 18 is coupled to a motor driven shaft 20 which is supported by motor bearings 20*a*. The magnet 18 is called the drive magnet. The drive magnet 18 is magnetized with opposing poles oriented radially about the axis of shaft 20. The drive magnet 18 is connected to motor shaft 20 by means of a drive magnet caddy 19. The caddy 19 is preferably made from moldable plastic. The magnet 18 tightly fits inside the caddy 19 and is preferably designed to be press fit into place. The drive magnet caddy 19 includes a center-hole 19*a* to facilitate mounting the caddy on the motor shaft using a press fit or other appropriate means. Accordingly motor shaft 20, caddy 19, and drive magnet 18 are positioned coaxially to each other. The caddy 19 is positioned coaxially inside of hollow cylinder 11 formed inside of and integral with housing 12 of the drive module 10*b*. The cylinder 11 act as a bushing to support mechanical loads imparted on caddy 19 by drive magnet 18. A time cyclic, polarized magnetic field is created as the drive magnet rotates about the axis of shaft 20.

The motor drive module 10*b* may serve as a mounting base for the pump head 10*a*. As seen in FIG. 1, the drive module includes a base plate 12*a* and associated mounting holes for securing the drive module to a support or other device.

While the drive magnet 18 and the caddy 19 may be directly mounted on the motor shaft 20, in some applications it may be desirable to rotate the drive magnet 18 at a different speed than the motor shaft speed. Thus another embodiment is envisioned wherein a gear train may be positioned between the motor 16 and the drive magnet 18 to provide for a customized ratio of motor rotation speed to the drive magnet rotation speed.

Figure 3A:
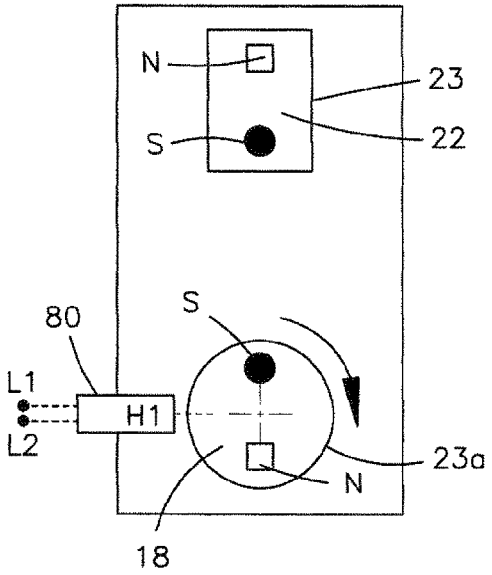
FIGS. 3A and 3B schematically illustrate the operation of one embodiment of the invention.
Figure 3B:
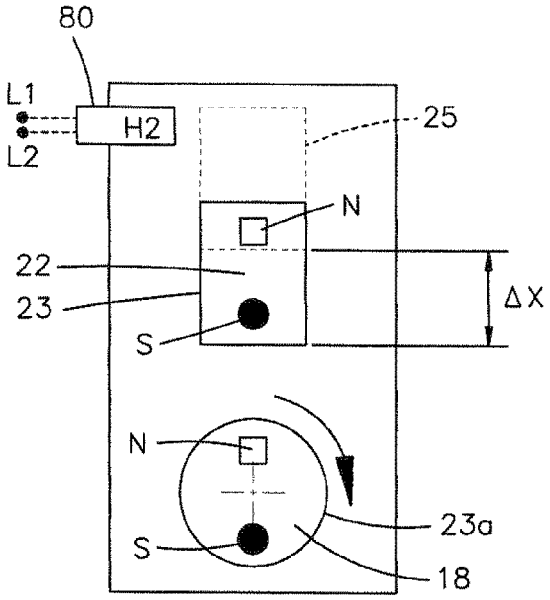

A reciprocally movable "driven" magnet 22 is encapsulated inside the pump head 10*a*. The driven magnet 22 is also bi-polar and preferably shaped as a cylinder, cube or a disc. However unlike the drive magnet 18, the driven magnet 22 is preferably axially magnetized with opposing poles located at respective axial ends of the magnet. FIGS. 3A-3B show the pole orientations of the drive magnet 18 and driven magnet 22, and featuring an end view to show rotation of the drive magnet 18. Poles N and S represent reference North and South poles, respectively. N and S are radially opposed in the drive magnet 18, and axially opposed in the driven magnet 22. Various methods to position the driven magnet 22 inside the pump head 10*a* are possible depending on the application and pump head type. The disclosure that follows summarizes a preferred embodiment for application with a piston pump head. However, as will become apparent to one skilled in the art, the principles of the disclosed pump assembly 10 may be applied to other pumping methods that require linear cyclic motion to facilitate the pumping action, including but not limited to diaphragm pumps.

Referring to FIG. 2, the pump head 10*a* is mounted in a fixed position such that there is a precise orientation between the drive magnet 18 and driven magnet 22. The magnets must be in close enough proximity to develop sufficient magnetic forces, both attracting and opposing forces, to propel the driven magnet 22. As the drive magnet 18 rotates about shaft 20, a cyclic magnetic field alternatively pushes and pulls driven magnet 22 in a linear cyclic motion. A piston carriage 24 is the moving structure that produces "pumping" action. In the illustrated embodiment, the driven magnet 22 is integrated with piston carriage 24 such that when the drive magnet causes movement in the driven magnet 22, both the piston carriage 24 and the driven magnet 22 move in unison. The volume displacement of the piston carriage alternately pulls fluid into a pump chamber 25 (shown best is FIGS. 2A and 3B) of the pump head 10*a* through an inlet (suction) port 28 and check valve 27 and then pushes fluid out of the chamber 25 of the pump head through an outlet (discharge) check valve 29 and outlet (discharge) port 30.

There are many different choices available for type of check valve that may be used for the check valves 27, 29 including ball checks and elastomeric checks such as umbrella and duckbill checks. Ideally the check valve should have zero backflow leakage. The check valves may be specified for opening or "cracking" pressure in the forward flow direction to prevent upstream pressure from pushing fluid forward through the pump head when the pump is idle.

Assuming the drive magnet 18 has 2-poles (N and S), one 360 degree rotation of the drive magnet causes one complete stroke (forward and reverse) of the driven magnet 22 and the piston carriage 24. The drive magnet 18 may be specified with multiple, even numbers of poles, i.e., 2, 4, 6 or 8. For example, a 4-pole magnet (with 2 N's and 2 S's) will result in 2 complete strokes of the driven magnet 22 for each 360 degree rotation. Regardless of the number of poles in the drive magnet 18, the driven magnet 22 is always specified with 2 poles.

An alternate embodiment included in the scope of the present invention includes the configuration of an array multiple bi-polar drive magnets that are radially positioned about the axis of shaft 20 and mechanically coupled with said shaft. The pole axes of each of said magnets are also radially oriented and sequenced with alternating polarity. Such embodiment provides ability to greatly increase the stroke rate of the driven magnet by increasing the number of alternating magnet poles presented to the driven magnet for each revolution of shaft 20. In such embodiment, an alternate drive magnet caddy structure is necessary to position and mechanically couple said multiple bi-polar magnets to shaft 20 in the manner described. The description of the preferred embodiment that follows is limited to application of a single bi-polar drive magnet 18.

FIG. 3 shows the stroke distance represented as ΔX and the geometric relationship between the drive and driven magnet poles as the drive magnet 18 rotates about the motor shaft 20 and induces alternating linear motion in the driven magnet 22. FIGS. 3A and 3B respectively show the Top Dead Center (TDC) and Bottom Dead Center (BDC) positions of the driven magnet 22 which represent the polar extremes in linear movement within one completed stroke. For simplicity of illustration piston carriage 24 and driven magnet 22 are represented schematically as a rectangular block 23 in FIG. 3. Likewise, caddy 19 and drive magnet 18 are represented as a circular (cylindrical) block 23*a* in FIG. 3.

Both drive and driven magnets 18, 22 are preferably permanent and may be made from any suitable magnetic material, and most preferably of the rare earth element type which provides superior magnetic strength and longevity. Magnet shapes other than cylindrical may be alternately used to customize the magnetic field strength and shape to meet specific application requirements.

Figure 2A:
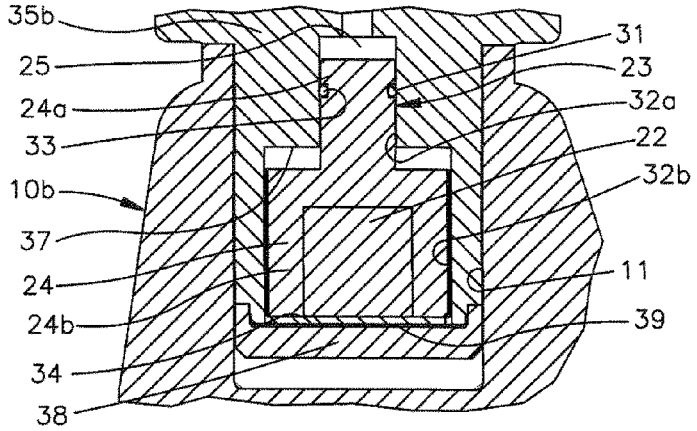
FIG. 2A is a fragmentary sectional view of a portion of the pump assembly shown in FIG. 2.
Figure 2B:
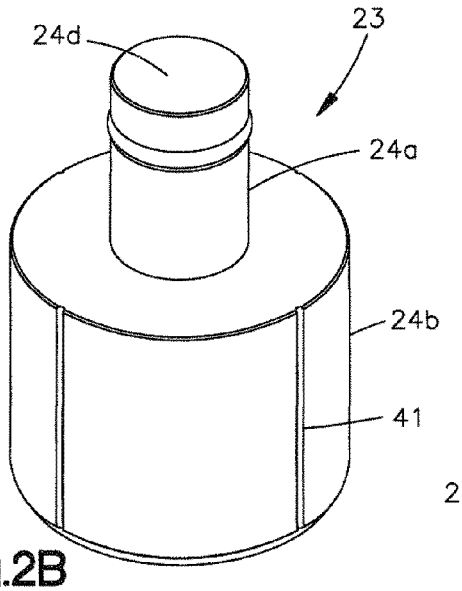
FIG. 2B is a perspective view of a piston assembly forming part of the pump assembly shown in FIG. 1.
Figure 2C:
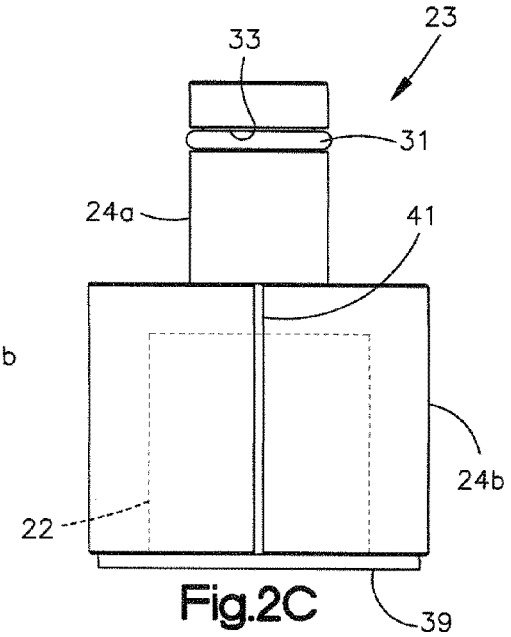
FIG. 2C is a side elevational view of the piston assembly shown in FIG. 2B.
Figure 2D:
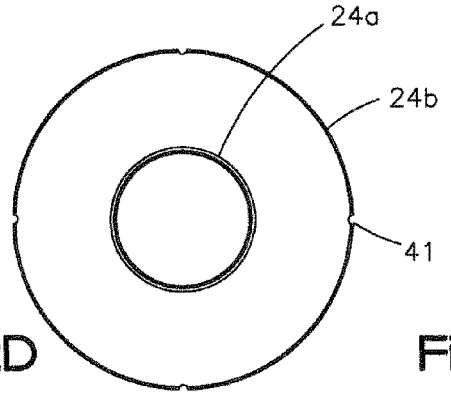
FIG. 2D is an end view of the piston assembly shown in FIG. 2B.
Figure 2E:
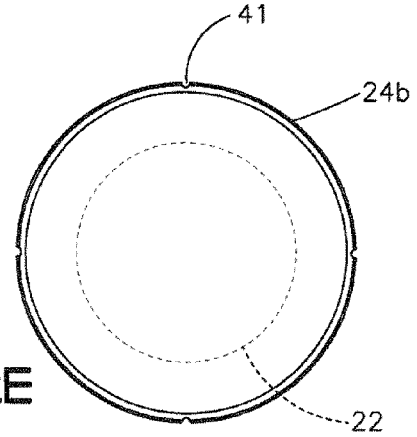
FIG. 2E is another end view of the piston assembly.

Referring to FIGS. 2 and 2A, the driven magnet 22 is integrally connected to piston carriage 24, creating a three (3) component piston assembly 23 that includes the carriage 24, an O-ring 31 plus the driven magnet 22. The carriage 24 consists of upper and lower sections or portions 24*a* and 24*b*, respectively. The piston assembly is reciprocally movable in a stepped bore 32 having an upper portion 32*a* that slidably receives the piston portion 24*a* and a lower larger diameter portion 32*b* that slidably receives the lower piston portion 24*b*. The upper piston portion 24*a* functions as the piston and is provided with a circumferential groove 33 to mount O-ring seal 31 on piston portion 24*a*, and to provide a seal between the piston portion 24*a* and the inside wall of upper cylinder section 32*a*. The O-ring material is preferably an elastomer that is compounded with lubricating elements such as Teflon to reduce friction between the elastomer and the upper cylinder section 32*a*.

It should be noted here that the carriage 24, in which the driven magnet 22 is located, forms a reciprocally movable piston assembly 23. This piston assembly moves between two extreme positions, the upper position shown in FIG. 2 and the lower position shown in FIG. 2A. In the FIG. 1 embodiment, the piston assembly serves as a pumping element such that when it reciprocally moves between its upper and lower positions, it pumps fluid from the inlet to the outlet by virtue of the check valves 27 and 29. This principle of operation can be used to perform other functions. For example and as will be described, the piston assembly 23 can be used to control the flow of fluid through a passage such that in one position, flow is permitted and in a second position, flow is blocked. To provide this function, and as will be further described, the piston may be fitted with a seal and a valve seat may also be provided which is engaged by the piston carried seal, such that when the piston sealing engages the seat, flow is blocked. Finally, the piston assembly 23 can be used to actuate other components that must be moved between two extreme positions. It should be noted that the extremes of motion for the piston assembly 23 are determined by the bore 32 and the stop or stopped surfaces defined by the bore 32 which are engageable by the piston assembly 23 and which, thus, serve as piston stops.

Preferably the lower portion 24*b* of the piston carriage is designed to allow the driven magnet 22 to be easily press fitted into the piston carriage 24 Both upper and lower portions 24*a* and 24*b* of piston carriage 24 are coaxially centered inside the upper and lower bore/cylinder sections 32*a* and 32*b*, with each cylinder section respectively cored inside a lower body portion 35*b* of pump head sub-assembly 10*a*. The driven magnet 22 being coaxially centered inside lower carriage section 24*b*, is also coaxial with lower cylinder section 32*b*. The linear motion of the piston assembly 23 is guided by both the upper and lower cylinder sections 32*a* and 32*b* of the stepped bore 32, respectively. A surface 34 represents the bottom surface of lower cylinder section 32*b* and is the inside surface defined by a bottom wall 38 of the lower body section 35*b* of the pump head 10*a*. A surface 37 represents the transition between upper and lower cylinder sections 32*a* and 32*b*, respectively and is the top of lower cylinder section 32*b*. Accordingly, the stroke ΔX (FIGS. 2 and 3B) of the piston assembly is established by the range motion provided lower carriage portion 24*b* moving between fixed surfaces 37 and 34.

FIGS. 2B-2E shows detailed views of piston carriage assembly 23. Vents 41 are channels located on circumference of lower carriage portion 24*b*. The vents 41 may be characterized as grooves that span between the bottom and top of lower carriage portion 24*b*. FIGS. 2A-2D shows four (4) vents 41 spaced radially 90 degrees apart when viewing from a top view of assembly 23. The purpose of the vents 41 are to provide a pathway for the movement of air enclosed inside bore/cylinder 32 in order to equalize pressure as carriage 24 moves between surfaces 37 and 34. This is to prevent trapped air from becoming compressed, thereby acting as a resisting spring and preventing the motion of carriage 24 between surfaces 37 and 34. Accordingly the vents 41 equalize the air pressure inside bore/cylinder 32, around the exterior of lower carriage portion 24*b* and between the surfaces 37 and 34.

A mechanical impact occurs each time the carriage portion 24*b* is momentarily stopped by the fixed surfaces 37 and 34. The mechanical impact is characterized by a repeating tapping or clicking noise. The strongest impact occurs when the driven magnet 22 is pulled toward the drive magnet 18 at the bottom of the stroke. This is because the two magnets are in closest proximity and the attractive forces between the magnets are maximized. The impact of carriage portion 24*b* against the surfaces 37 and 34 may also cause hydraulic pressure pulsations inside the pump head 10*a* if the working fluid is an incompressible liquid such as water. These pressure pulsations may be large enough to cause premature opening or "cracking" of check valves 27 and 29 resulting in the incremental forward flow of liquid greater than the volumetric displacement of the piston. This effect is undesirable because it causes other than a 1:1 relationship between piston stroke volume and the volumetric flow rate, thus reducing the pump's predictive pumping accuracy based on the stroke volume.

To reduce this tapping noise that may be objectionable, and to ensure that the pump flow rate is exactly equal to the volumetric displacement of the piston, a flexible shock absorbing disc may be fastened to one or both of the top and bottom surfaces of lower carriage 24*b*. A shock absorbing disc 39 is preferably glued to the bottom surface of lower carriage 24*b* and is a thin silicone foam or sponge or other elastomers, approximately 0.040" to 0.080" thick, such as manufactured by Stockwell Elastomerics, that are flexible, durable and resist compression set to ensure repeatable stroke distance. The momentary compression distance of disc 39 is inclusive in the stroke distance ΔX.

The pump cycle may be referenced with the piston carriage 24 starting its linear cyclic motion at TDC and drive magnet 18 at 0 degrees (reference) rotation position as shown in FIGS. 2 and 3A. In this starting position proximal poles of the drive and driven magnets are opposing to each other, and thus the driven magnet 22 is pushed by opposing magnet force into the TDC position. Once the drive magnet 18 rotates 180 degrees, the proximal poles of the drive and driven magnets become attractive, and the driven magnet is then pulled by attractive magnetic force into the BDC position (FIGS. 2A and 3B). The internal volume of pump head 10*a* is defined by the internal pump cavity 47 contained between the cavity side walls, check valves 27 and 29, piston portion 24*a* and 24*d* of carriage 24, O-ring 31 and cylinder section 32*a* above O-ring 31. As the piston moves from TDC to BDC position, the internal volume increases causing a reduction in pressure inside cavity 47. The discharge check valve 29 prevents backflow of fluid from downstream of the check valve. However, inlet check valve 27 allows fluid to flow through inlet port 28 into the cavity 47, provided the pressure differential between fluid upstream of inlet port 28 and cavity 47 exceeds the cracking pressure of check valve 27. The incremental volume of fluid entering cavity 47 is piston stroke distance ΔX multiplied by the cross sectional area of upper cylinder section 32*a*.

As the drive magnet 18 continues rotation from 180 to 360 degrees completing a full revolution, the driven magnet 22 likewise is pushed by the drive magnet 18 back to the original starting position TDC (FIGS. 2 and 3A). During this motion volume in cavity 47 is reduced and the pressure in cavity 47 increases. Suction check valve 27 prevents backflow of fluid from downstream of the check valve. Once the internal cavity pressure exceeds the cracking pressure of discharge check valve 29, fluid then flows from cavity 47 into discharge port 30 and exits the pump head 10*a*. Likewise the incremental volume of fluid discharged from the pump head 10*a* is the stroke ΔX multiplied by the cross sectional area of upper cylinder section 32*a*.

An important characteristic of the pump is its ability to create a high negative pressure (vacuum condition) at the pump suction (inlet port) in order to prime the pump with a liquid working fluid, and especially when the suction line to the pump and the pump itself is void of liquid and is considered "dry". In order to maximize the dry suction lift capability of the pump, the volume of cavity 47 must be minimized when the piston carriage is at the TDC position. According to the Boyle's Law, the negative vacuum pressure that may be achieved inside of cavity 47 is expressed by the following equation:

$$\text{Vacuum Gage Pressure}=(\text{Atmospheric Pressure})\times(1-((\text{Cavity Volume}@TDC)/(\text{Cavity Volume}@BDC)).$$

In order to achieve the maximum priming capability, vacuum pressure must be maximized and thus cavity volume at TDC position must be minimized according to the above equation. Thus it is desirable for the top surface 24*d* (shown in FIG. 2A) of upper piston carriage 24*a* to nearly contact or become conformal with a top inside wall surface of upper bore/cylinder section 32*a* of the cavity 47 when the piston carriage is at TDC position. It is also desirable to locate check valves 27 and 29 as close as possible to the upper piston portion 24*a* of carriage 24 so as to minimize volume of cavity 47 at the TDC position.

The optimal cyclic speed range of the piston assembly is estimated to be a range up to 10 Hz. This is based on the observed operation of driven magnets applied in the size range of 0.50" diameter by 0.50"long and applied with a stroke distance of 0.100". Above 10 Hz it is possible the piston may not complete full strokes because the inertia of the piston carriage assembly overcomes the magnetic attracting and repulsing forces induced by the drive magnet. Smaller driven magnets (with lower inertial mass) combined with larger drive magnets (having greater magnetic field strength) may allow speeds substantially higher than 10 Hz while maintaining full strokes with zero or minimal stroke slippage. Higher speed may also be achieved by reducing the stroke distance.

In an alternate embodiment the driven magnet 22 may directly serve as the piston without need for a piston carriage, wherein the driven magnet 22 is coated in a material such as electrolous nickel that is inert and suitable for direct contact with medical fluids, food and beverage concentrates. This embodiment also requires an O-ring 31 to provide a dynamic seal between the magnet 22 and the inside surface of upper cylinder wall 32*a*. A circumferential groove may be formed directly on the driven magnet to secure O-ring about said magnet.

Another embodiment may adapt to a diaphragm pump. The piston or driven magnet 22 may be over molded integral with the rubber diaphragm. Cyclic linear motion of the driven magnet 22 may cause the diaphragm to flex back and forth to create the volumetric pumping action.

Figure 5:
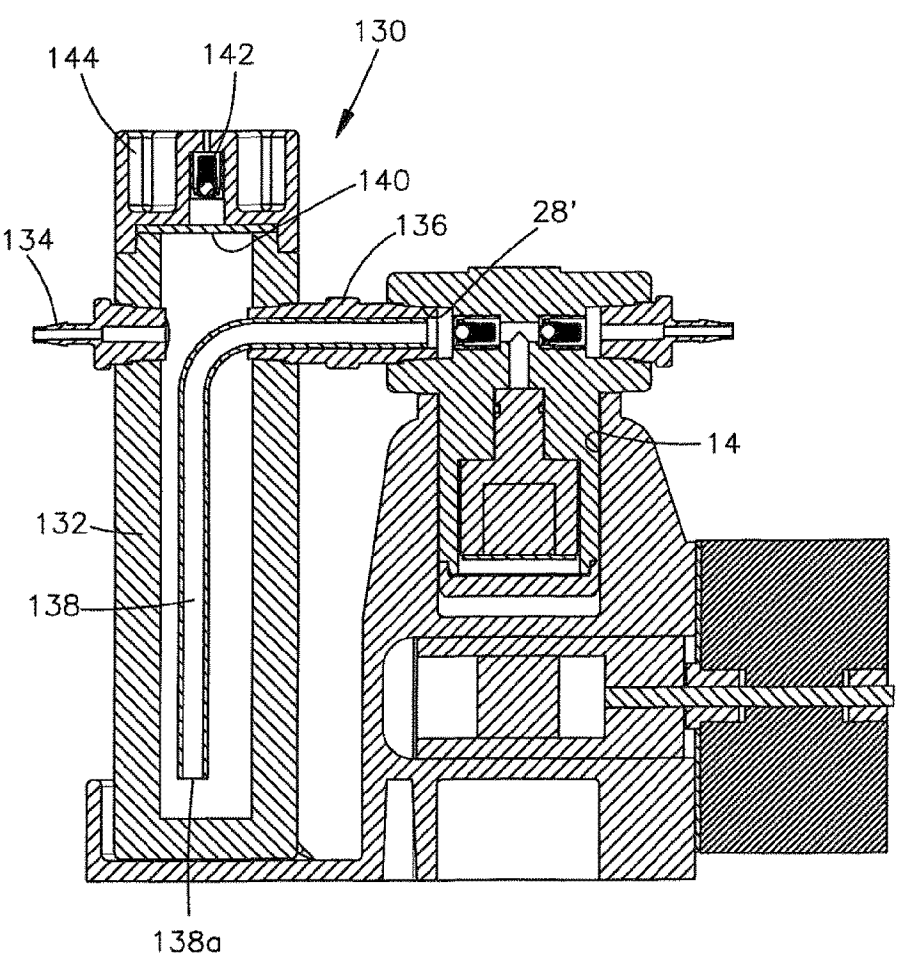
FIG. 5 is a sectional view of the pump assembly shown in FIG. 4.
Figure 4:
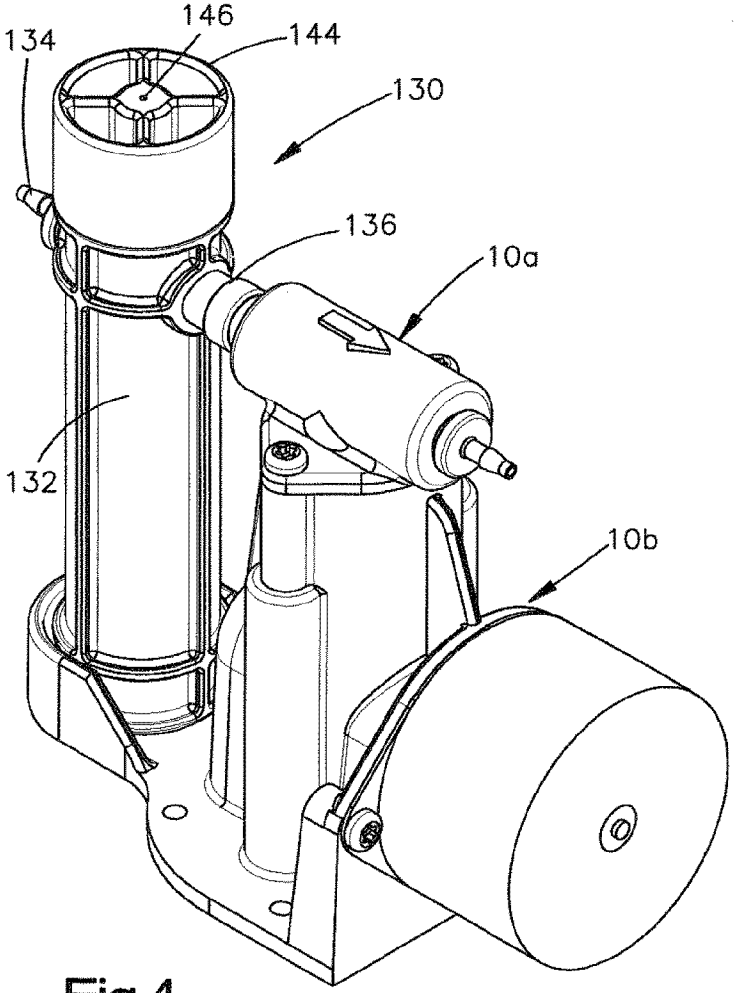
FIG. 4 is a perspective view of a pump assembly, including an air-bleed accumulator constructed in accordance with a preferred embodiment of the invention.

Referring to FIGS. 4 and 5, another embodiment encompasses the pump head sub-assembly 10*a* being adapted with a suction accumulator or air bleed assembly 130. The purpose of the accumulator assembly is to remove air from the suction tubing that connects pump inlet port 28 with an atmospheric pressure liquid reservoir such as a bag-in-box or IV solution bag. The suction accumulator assembly consists of a hollow, cylindrical body 132, accumulator inlet port 134, accumulator outlet port 136, dip tube 138, gas permeable membrane 140, accumulator check valve 142 and accumulator cap 144 as shown in FIGS. 4 and 5. FIG. 4 is an isometric view of the pump assembly of this embodiment. FIG. 5 is a sectional view A-A of the pump assembly shown in FIG. 4.

In order for the accumulator assembly 130 to properly function, the highest elevation of fluid contained in the liquid reservoir bag must be positioned slightly higher than the elevation of the inlet port 134 (at least 24 mm and preferably greater than 100 mm). This is to provide enough hydrostatic pressure to allow the free flow of liquid from the bag into the accumulator when a full bag of liquid is initially connected by tubing to the accumulator inlet.

Membrane 140 is semi-permeable and may be a material such as chemically inert PTFE Teflon (manufactured by Porex Technologies or W.L. Gore & Associates) with pore size preferably ranging between 5 and 30 micron and thickness ranging between 0.10 and 1.0 mm. Membrane 140 allows the free flow of gases such as air to pass through unimpeded with low pressure loss. The membrane however blocks the flow of liquids. The hydrostatic pressure of the liquid reservoir acting on the suction accumulator inlet port pushes trapped air ahead of advancing liquid exiting the bag and moving towards the accumulator inlet. As both liquid and trapped air bubbles enter the accumulator through inlet port 134, the liquid and air separate by gravity with the liquid on the bottom and air on the top. As liquid fills the accumulator, hydrostatic pressure pushes air through the membrane 140, check valve 142 and vent hole 146 to exhaust to atmosphere.

Check valve 142 must be provided with low cracking pressure, preferably less than 24 mm of water column to facilitate the exhaust of unwanted air without requiring excessively high air pressure inside body 132, that would otherwise require an increase in the elevation of the fluid reservoir bag to increase the hydrostatic pressure inside body 132.

Accumulator outlet port 136 connects directly to the pump inlet or suction port 28'. Thus as the pump operates it creates a reduced pressure at port 136 that draws fluid contained inside accumulator body 132 into the pump. Dip tube 138 is provided so that liquid is drawn from the bottom of the accumulator. As long as liquid is maintained above the dip tube inlet 138*a*, only liquid is drawn into the pump suction.

As the pump operates and the fluid reservoir bag becomes nearly depleted, it may be possible for the pressure inside accumulator body 132 to fall to less than atmospheric pressure. This is the result of a loss in positive hydrostatic pressure maintained at inlet 134. Accordingly check valve 142 is provided to prevent back flow of atmospheric air into the accumulator. The accumulator body should be sized with enough fluid containing capacity to prevent the accumulator from becoming empty as the reservoir bag becomes depleted. This of course requires the depleted bag to be replaced in a timely manner. Upon connection of a new, replenished bag, any air drawn into the tubing connecting the bag to the accumulator inlet will then become expelled as the fluid contents in the bag start to flow towards the accumulator inlet.

It should be noted here that the disclosed pump head sub-assemblies 10*a* of the various disclosed embodiments include an upper body section 35*a* that includes inlet and outlet ports 28 and 30, check valves 27 and 29, plus lower body section 35*b*, the exterior portion of which provides a precise interface 35 for mounting or "docking" the pump head 10*a* with the drive module 10*b*. Lower body portion 35*b* of the pump head is precisely positioned inside mating receptacle or cavity 14 internally formed as part of housing 12 of motor drive module 10*b*. Inlet and outlet check valves 27 and 29 are positioned inside the pump head near respective inlet and outlet ports 28 and 30 to prevent back flow, and to facilitate accurate delivered fluid volume for each stroke of the driven magnet.

Control Module

Figure 7:
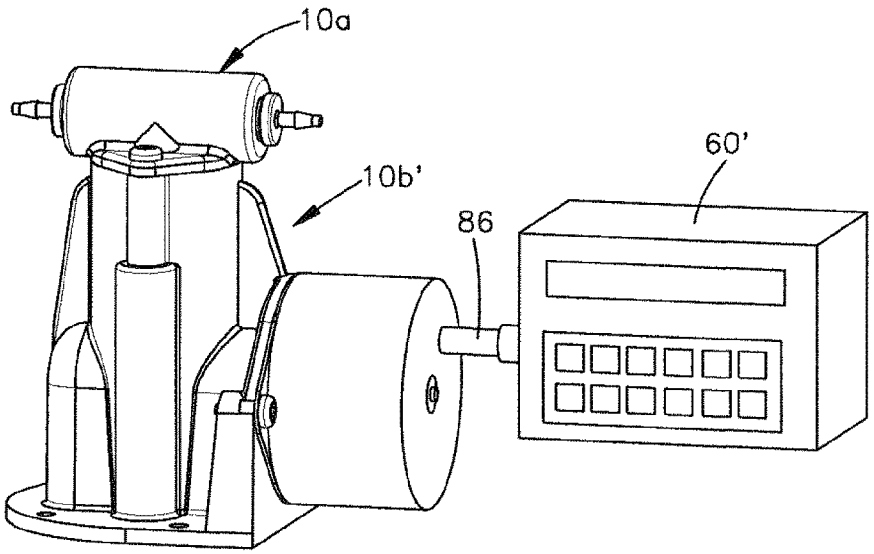
FIG. 7 is a perspective view of the pump assembly constructed in accordance with a preferred embodiment of the invention as connected to a remote control module.

The motor drive module 10*b* is activated by selective application of voltage to power the motor 16. Depending on the type of motor applied (DC motor, AC synchronous motor, or stepper motor), suitable electronic controls, software, and operator interfaces, must be provided to program and activate the voltage to motor 16 which in turn causes the drive magnet 22 to rotate and thereby activate the pumping action of pump head 10*a*. Collectively the electronic controls, software and operator interfaces are referred to as the "Control Module". The control module may be 1) located remotely from the drive module assembly 10*b* and electronically connected via suitable cables as shown in FIG. 7 or wireless communication systems such as Bluetooth technology (not shown) or 2) physically integrated with the drive module 10*b* as shown in FIG. 6.

Figure 6:
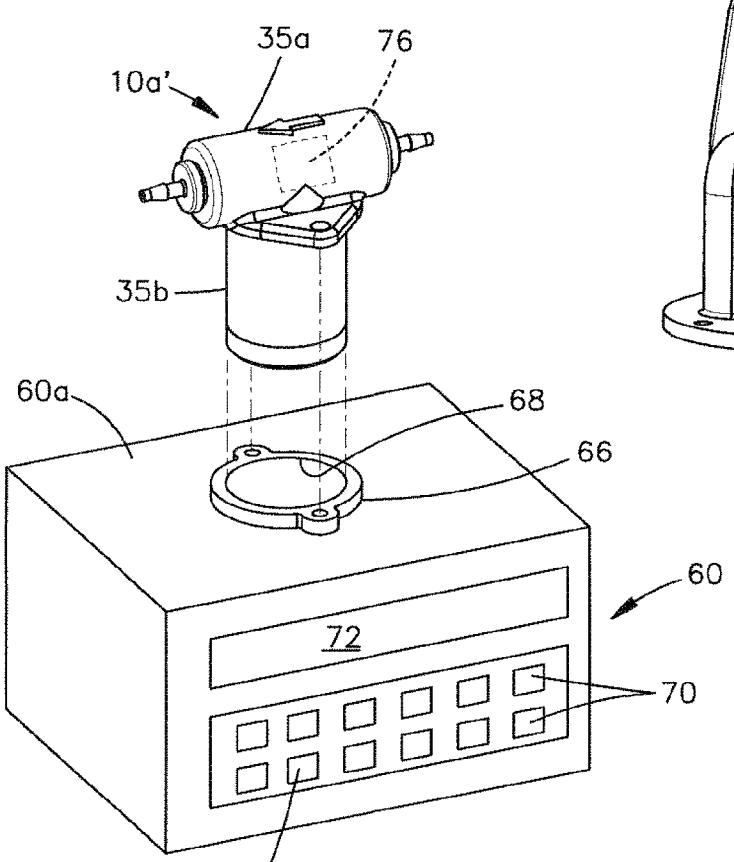
FIG. 6 is a perspective, partially exploded view of a pump assembly constructed in accordance with a preferred embodiment of the invention and an associated control module.

Referring to FIG. 6, a drive module similar in function to the drive module 10*a* is positioned inside a cabinet housing 60*a* of a control module assembly 60 and is generally hidden from view. Docking structure 66 is exposed to provide a platform to which a pump head 10*a*' is mounted. The lower body section 35*b* passes through an opening 68 defined by the docking structure 66 and is received by a motor drive module located within the housing 60*a*. Suitable fasteners secure the pump head 10*a*' to the control module. The control module 60 also includes components such as microcircuits, power supplies, external switches, push buttons 70, displays 72, etc. that support the functioning and control of drive motor 16 (not shown in FIG. 6). The control module assembly 60 may also include data transmission hardware, firmware, and/or software that may transmit operating status, alarms, instructions, operating history etc., to/from an external data network.

The pump head 10*a*' may also be designed to mount radio frequency identification (RFID) tag 76 (shown schematically in FIG. 6) on any portion of pump head 10*a*'. An RFID reader would accordingly be positioned inside the control module 60 and in a suitable location in close proximity to the docking station 66 and RFID tag 76. This way the control module may automatically read a unique product identifier provided by the RFID tag. Pump heads with different stroke volumes and pumping capacity may be automatically identified and programmed into control system logic that is optimized to the specific pump head. Thus the range of flow rate for a given control module and drive module may extend a wide range, and provide the user with specific pump capacity and flow rate information through display 72.

In some medical applications, an independent confirmation of positive pump action may be required by U.S. Food and Drug Administration rules for medical devices. The proposed pump system provides for such requirement. Referring in particular to FIGS. 3A and 3B, a magnetically susceptible Hall Effect device, or magnet activated switch 80 may be integrated with the control module 60 (or with the drive module 10*b* in the event that the control module is remotely located) and in close proximity to pump head 10*a* in such a way that the fields of the drive magnet 18 (FIG. 3A) and/or driven magnet 22 (FIG. 3B) are sensed. Each time the driven magnet 22 moves to the top of its stroke the Hall Effect sensor H2 opens or closes a switch providing confirmation that the pump has completed a stroke. Likewise, each time the drive magnet 18 rotates 180 degrees (in the case of a 2-pole drive magnet) the Hall Effect sensor H1 opens or closes providing confirmation that the driven magnet has completed a half revolution which corresponds to a half stroke of the piston.

H1 is a sensor that detects either the N or S, or both N and S poles of the radially magnetized drive magnet. H2 is a sensor that detects just one pole N or S of the longitudinally magnetized driven magnet. In the relative position shown in FIG. 3B, the sensor H2 detects the N pole. The relative position of H2 is preferred because H2 must not be too close to the drive magnet that it detects the drive magnet poles and sends a faulty signal.

Leads L1 and L2 communicate electronic signals between Hall Sensors 80 and the Control Module. There may be more than 2 leads. The number of leads is determined by the sensor model and type of output signal created, for example digital or analog.

An example of a Hall Effect sensors that may be applied with the magnet pump are model HSC sensors as manufactured by Sensor Solutions Corp. of Steamboat Springs, Colo. (see www.sensorso.com).

The microelectronics contained in the control module 60 may use the Hall Effect sensor input in two important ways: 1) calculate the stroke rate, corresponding pumping rate, compare to a desired set point, and then make adjustments of motor speed to correct for set point deviations, and 2) maintain a timed history of the number of pump strokes completed and use this information to calculate and display flow rate and total dispensed volume. In an embodiment wherein motor 16 is a stepper motor, the electronic controller in the control module 60 will always know the precise angular location of the drive magnet 18, and by association driven magnet 22. Should the Hall Effect sensor H2 not respond as expected by the control module 60 at the time the driven magnet 22 is calculated to be at the top (or bottom) of its stroke, then an alarm condition will sound notifying the operator that there has been a malfunction. When in an "alarm condition", the control module may selectively disable the pump or otherwise revert to a pre-defined fail safe mode of operation.

In FIG. 7 a control module 60' is remotely attached to the motor drive Module 10*b*' via communication cable 86. In this embodiment the control module operates in the same manner and using the same control logic as if the control module were fully integrated with the motor drive module that is shown in FIG. 6. If a Hall Effect sensor 80 (shown in FIGS. 3A and 3B) is used in the FIG. 7 application, then it is preferably mounted inside the motor drive module 10*b*'. Also if an RFID tag 76 (shown in FIG. 6) is affixed to the pump head, then the RFID reader would need to be located inside the drive module 10*b*'.

Returning to FIG. 6, the docking structure 66 may accommodate quick attachment and release of the pump head 10*a*'. Custom designed exterior features in the pump head and docking section may facilitate easy placement and containment of the pump head with quick connecting clamps or other types of quick release fasteners. Since the lower body section 35*b* of pump head 10*a*' is preferably cylindrical in cross section, the pump head may be rotated 360 degrees to preferred radial orientation when docked on the control module 60. This may provide users with convenience of adjusting the inlet and outlet ports universally to any desired position.

Another embodiment provides for integration of multiple docking stations parallel to each other and for simultaneous operation of multiple pump heads. The motor assembly contained inside the control module 60 or as part of a remote drive module 10*b*', may include a lengthened drive magnet caddy (not shown) to provide room to mount multiple drive magnets, or to mount a single drive magnet with increased length. Either embodiment facilitates the ability to drive more than one pump head from a single motor. This way the multiple pump heads are synchronized to operate at the same speed provided for by the common, lengthened the drive magnet caddy. Each pump head may be selected for a customized stroke volume as required for the application. Synchronizing the operation of multiple pump heads is useful in applications that require multiple fluids to be delivered at precise flow rate and in precise volumetric ratio to one another. Use of a single control module 60 or drive module negates the need for multiple drive modules, thus reducing cost and complexity, while increasing ease of use. Of course the operator interface (LCD display, push buttons, and software) would all be custom designed to accommodate operation of parallel, synchronous pumps heads.

The control module 60 may be programmed to operate the drive module under two modes of operation: Uniform Dosing Mode and Intermittent Dosing Mode. When set to Uniform Dosing Mode, the control module 60 may be selectively programmed to pump uniformly (or continuously) at a specified flow rate. When set to Intermittent Dosing Mode, the control module 60 may be selectively programmed to incrementally dispense a pre-set volume of fluid at a programmed time interval and at a specified flow rate.

Uniform and Intermittent Dosing Modes may be achieved using either DC or AC motors to rotate the drive magnet 18. Using a DC motor or stepper motor provides the flexibility for the control module to adjust the motor speed through selective adjustment of the DC voltage. In other applications it may be desirable achieve a highly precise, constant motor speed by using an AC synchronous motor. In this case the desired flow rate is established by the volumetric capacity of the selected pump head in combination with the highly accurate, constant speed provided by the synchronous motor.

Before considering the modes of operation in more detail, it must be recognized that the magnetic flux field developed between the proximal poles of the drive and driven magnets is known to be non-linear with respect to rotation position of the drive magnet. This causes a non-linear relationship between the angular rotation position of the drive magnet and the intra-stroke position of the piston. Stroke-to-stroke volume consistency is not impacted by this intra-stroke non-linearity. In very low flow rate situations requiring partial intra-stroke steps, the non-linearity must be compensated for to provide uniform volume displacement as the piston advances in incremental, intra-stroke steps. Intra-stroke step compensation can be accomplished by programming the control module 60 to correct for the true relationship between the angular rotation position of the drive magnet and the intra-stroke position of the piston. The true relationship may be determined either through theoretical modeling of the dynamic magnetic forces, or through empirical testing. Theoretical modeling is a very complex endeavor and must ultimately be validated by empirical testing. Thus empirical testing is deemed to be the most accurate and direct method to establish the true relationship between angular rotation position of the drive magnet and intra-stroke position of the piston.

Uniform Dosing Mode

With consideration to full piston strokes or inter-stroke operation, the volumetric flow rate is calculated as the pump stroke rate times the pump's volume displacement per complete stroke. The mass flow rate is the volumetric flow rate multiplied by the fluid density which is constant for an incompressible fluid. If the working fluid is a gas, then a calculation correction would be required to determine mass flow rate using the Ideal Gas Law (PV=RT, where P=absolute pressure, V=specific volume of gas, R=ideal gas constant, and T=absolute temperature) and factoring the pump's internal pressure rise. The following description is oriented to application of an incompressible working fluid wherein the mass flow rate is directly proportional to volumetric flow rate.

The operator may set the desired volumetric flow rate through the user interface display pad positioned on the control module. For example, in the case of pumping an incompressible liquid, consider a piston pump head with a bore diameter of 5 mm (0.5 cm) and a stroke of 5 mm (0.5 cm) The stroke volume is the cylinder cross section area multiplied by the stroke distance ($0.20\ cm^2 \times 0.5\ cm = 0.10\ cm^3 = 0.10$ ml). If a uniform flow rate of 1 liter per hour is desired, then the strokes per hour required is calculated as follows: Strokes per hour=1,000 ml per hour/0.10 ml per stroke=10,000 strokes per hour. This equates to a manageable 167 completed strokes per minute. Assuming the drive magnet 18 is a 2-pole configuration where one revolution corresponds to one round trip piston stroke, and then the required rotation speed of the drive magnet is 167 revolutions per minute. In the case of applying a variable speed DC motor or stepper motor, the control module will accordingly operate the motor at a speed which satisfies the demand for 167 revolution per minute to provide one pumping stroke every 0.36 seconds.

While the mode of operation is considered "uniform", the actual flow is accomplished in very short duration increments or flow pulses. If "uniform" flow duty is very low, the time increment between pulses may be significantly lengthened as seen in the next example. Consider the same piston pump head, but the required flow rate is 1 ml per hour. This represents a reduction in flow rate of 1,000 times the previous example. Stroke rate=1 ml per hour/0.10 ml per stroke=10 strokes per hour. This equates to one stroke every 6 minutes. In a medical delivery application, a stroke period of 6 minutes (360 seconds) may be deemed too long or infrequent. Assuming a 60 second stroke period is acceptable, the Control Module may be programmed to complete partial strokes, wherein the stepper motor is controlled in fractional (discrete) rotational steps. While a full 360 degree shaft rotation is required to facilitate one complete stroke every 6 minutes (360 seconds), an incremental rotational step of 60 degrees every 60 seconds is equivalent to delivering an average or effective flow rate of 0.017 ml every 60 seconds. Thus the operator may set the flow rate and minimum period between stepper motor increments as needed for the application. The controller will also automatically apply the intra-stroke corrections as required to compensate for the known non-linearity between drive magnet rotation position and the intra-stroke position of the piston.

Intermittent Dosing Mode

In some cases the user may wish to dispense a fixed volume or dose of fluid at regular or irregular time intervals. This may be satisfied by setting the Control Module to operate in Intermittent Dosing Mode, where the user may set a customized dose volume and the time interval. The Control Module is interactive with the user, and thus the user may set virtually unlimited dosing instructions. Examples include fixed dose dispensed at regular time intervals, fixed dose dispensed at variable time intervals, variable does dispensed at regular time intervals and variable dose dispensed at variable time intervals.

The user may also program the total number of doses to be dispensed, start time, and/or finish time. Or the user may input a table of times and doses to be dispensed. The user may also specify the uniform flow rate at which the dose is to be dispensed.

A special application is envisioned wherein the disposable pump head contains a RFID tag that may be programmed with patient specific dosing information as prescribed by the doctor, in addition to the information that identifies the pump model and stroke volume. Or, the control module may be electronically integrated with a bar code reader that reads the patient's dosing prescription as printed on the bag containing the prescribed medical fluid. The control module 60 will then automatically confirm that the pump head is appropriate for the dose via communication with the RFID tag, and will ensure that the patient's dosing instructions are automatically programmed into the control module 60 as read from the bar code. This will eliminate dosing errors resulting from operator programming errors. Furthermore the control module may be linked to an external data network to provide the doctor with real time monitoring of the patient's dosing progress.

The pump assembly of the present invention provides an integrated fluid management platform with capability to deliver accurate flow rate and fluid dosing over a wide range of operator set parameters. The control module 60 can be programmed to provide Uniform Dosing (continuous flow rate) or Intermittent Dosing. Relatively high flow rates can be achieved with the Drive Module rotating the drive magnet such that the driven magnet advances in full strokes. However, extremely low flow rates may also be achieved by rotating the drive magnet 18 such that the driven magnet 22 advances in fractional strokes. The pump head is low cost, easy to mount to the drive module 10*b* or to the control module 60 (integrated with the drive module) and is potentially disposable. The pump port orientation may be fixed, may be universally set to any position, or may be allowed to freely rotate.

The pump head 10*a* may be adapted to a suction accumulator or air bleed assembly 130 to expel air pulled into the suction tubing in the special case of pumping liquids that are stored in an atmospheric storage vessel or flexible plastic bag or pouch.

Pump heads of different volumetric capacity may be interchangeably mounted or docked to a motor drive module 10*b* or to a control module 60 providing a wide range flow rate capability. Multiple pump heads may be docked to a single drive module or control module to provide concurrent metering of multiple fluids and to maintain precise volume ratio of the multiple fluids to one another. RFID tags may be affixed to the pump head 10*a* (or 10*a*') to allow the control module 60 to automatically identify the volumetric capacity of the pump head, and accordingly provide for automatic and error free compensation of all calculations used to control the motor function. The control module 60 may also be integrated with a bar code reader to input error free, customized dosing information into the control module. Positive sensing of the piston position can be achieved using a Hall Effect sensor 80 (See FIGS. 3A-3B) placed in proximity to the pump head inside the drive module or control module, and being triggered by the position of the drive magnet 18 and/or the driven magnet 22. This provides the control module with redundant capability to confirm stroke completion, and to sound an alarm or activate a fail safe mode should the feedback position from the Hall Effect sensor not match the expected position of the piston as calculated from the stepper motor position.

Additional Embodiments and Applications of Magnet Drive System

The magnet drive system that includes the motor 16, shaft 20, rotating drive magnet 18 and the linear motion driven magnet 22 is not to be construed as being limited to the pumping applications described above. The disclosed magnet drive principle may be applied anywhere the linear motion of a piston and a piston carriage assembly may provide a beneficial function. Citing just one example, the magnet drive system/principle described above may be applied to replace conventional electric solenoids used in fluidic shut-off valve assemblies. In prior art solenoid operated valves, the solenoid provides the electro-magnetic force to move a magnetically susceptible pole piece in linear motion. The pole piece is connected to an elastomeric seal that is used to block or constrict the valve's orifice. When the solenoid is not energized, a spring acts upon and positions the pole piece such that the valve's orifice is selectively blocked or closed by the seal. When the solenoid is energized, the resulting electromagnetic field acts on the pole piece. The pole piece pushes against the spring and moves the seal away from the orifice thus opening the valve. A limitation of conventional solenoid valves is the ability for the solenoid to move the pole piece and open the valve when there is high upstream pressure. The high upstream pressure presses against the seal and resists movement of the pole piece upon activation of the solenoid to open the valve. Solenoid power must be managed to prevent high current and overheating of the solenoid. Thus solenoid activated shut-off valves are often limited from being applied when high inlet pressure is presented to the valve.

The magnet drive system/principle described above in connection with a pumping application may be applied to replace the conventional solenoid and pole piece system. The disclosed magnet drive system may also provide increased ability to open the valve when there is high upstream pressure due to favorable power-torque characteristics of DC electric motors and gear motors used to rotate the drive magnet as compared to conventional solenoid valves.

Figure 9:
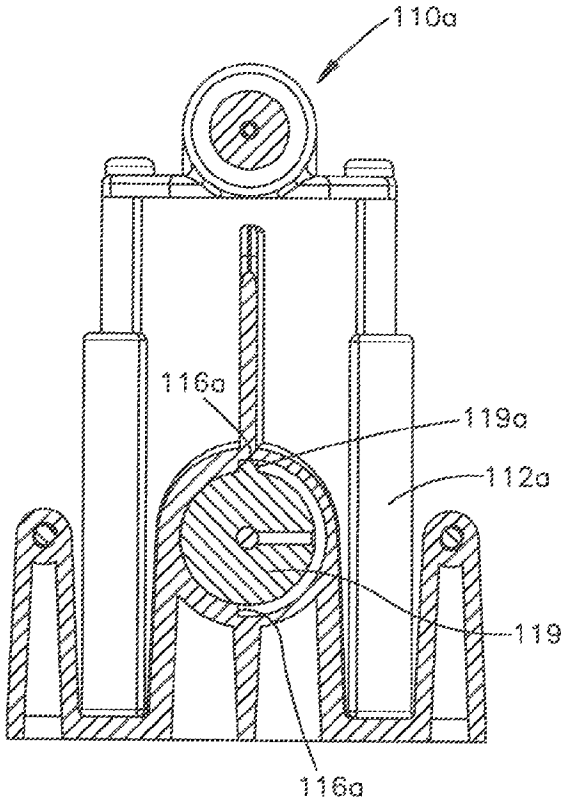
FIG. 9 is a sectional view of the control valve of FIG. 8 as seen from the plane indicated by the line 9-9 in FIG. 8.
Figure 8:
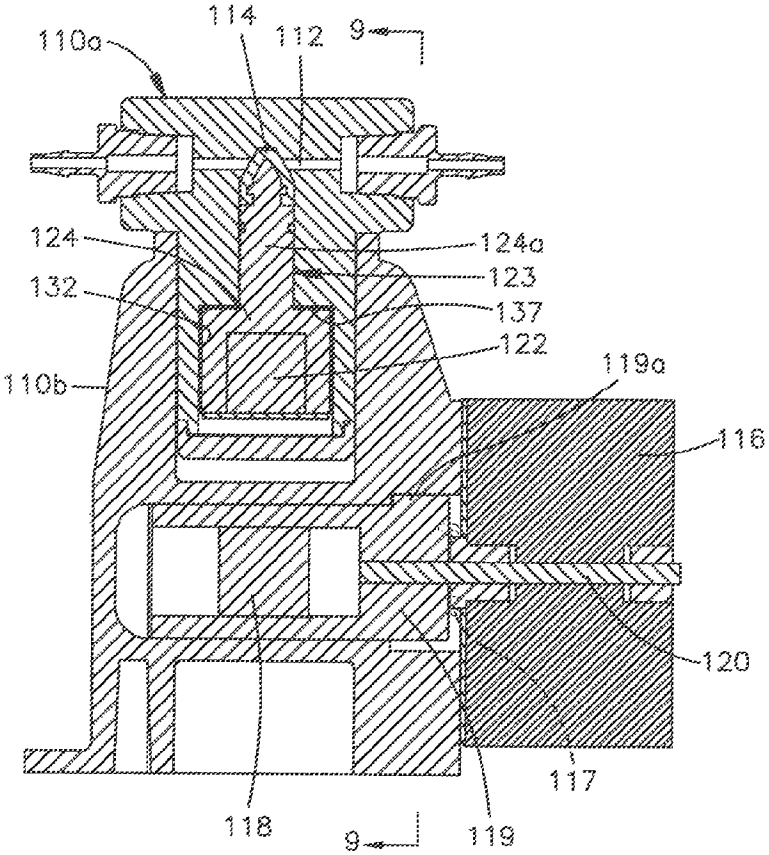
FIG. 8 is a sectional view of a control or shut-off valve constructed in accordance with another embodiment of the invention.

FIGS. 8 and 9 illustrate an embodiment of a modular valve head assembly 110*a* that utilizes the magnet drive system/principle of the present invention. According to this embodiment, the modular valve head assembly 110*a* replaces the modular pump head 10*a* shown in FIG. 1. The drive module 10*b* shown in FIG. 1 may be used with the valve assembly 110*a*; preferably a modified motor drive module 110*b* (to be described) is used.

According to this embodiment, a valve seal 114 is over molded or affixed with flexible rubber on upper carriage portion 124*a*. The seal is preferably tapered to press with adequate force against valve orifice 112 and thereby facilitate shut-off when the driven magnet 122 is moved to the TDC position as referenced in FIG. 3C. Surface 137 is accordingly designed not to limit the upward motion of carriage 123. Instead the upward motion of piston carriage assembly 123 is limited by the interaction of seal 114 pressing against orifice 112. As the driven magnet 122 moves into the BDC position, the piston carriage assembly 123 and seal 114 are retracted away from the orifice 112 thus opening the internal flow passage.

The rotational range of motion of drive magnet 118 and caddy 119 must be limited to 180 degrees (or ½ revolution) which corresponds to the motion of driven magnet 122 and of piston carriage assembly 124 between TDC and BDC positions. This may be accomplished through the application of a tab 119*a* affixed to caddy 119 and of strategically placed mechanical stops 116 *a* affixed to or defined by the drive module housing 112*a* in proximity to the caddy 119. A torsion spring 117 may also be adapted to resist the rotation of caddy 119 when motor 116 is energized. The opening and closing cycle of the valve assembly 110*a* may be described with the valve starting in the open position, the motor de-energized, and piston carriage assembly 124 and driven magnet 122 in the BDC position as defined in FIG. 3B. Upon energizing the motor 116, the caddy 119 and drive magnet 118 are rotated 180 degrees as afforded by the mechanical stop, the spring is wound and driven magnet 122 and piston carriage assembly 124 moves into the TDC position. Seal 114 presses against orifice 112 thus closing the valve. When the motor is subsequently de-energized, the torsion spring provides a return force component to assist rotation of the drive magnet assembly back into the starting position. Accordingly piston carriage assembly 124 moves into the BDC position, moving the seal 114 away from orifice 112 thus opening the valve.

When the motor is energized and the valve is closed, the motor is stalled against the mechanical stop 116*a* and driven magnet 122 and piston carriage assembly 124 are in the TDC position. Of course the motor must be selected so as to operate continuously in a stalled condition without over-heating. In the case of a reversible motor, for example a DC motor, the polarity of voltage applied to the motor may be reversed to reverse the rotation direction of the motor. In this case, the torsion spring may be eliminated, and the motor may be opened and closed by selectively reversing the polarity of the applied voltage presented to the motor.

Figure 3C:
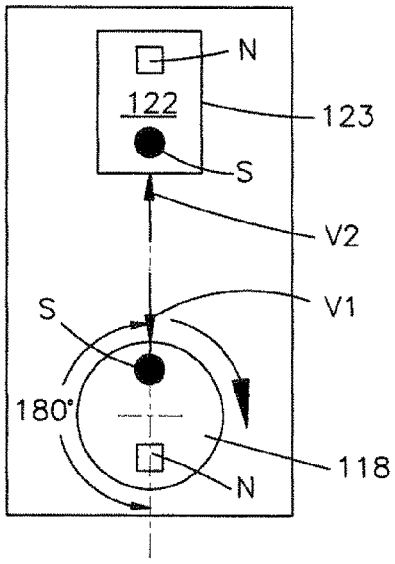
FIGS. 3C and 3D schematically illustrate a mode of operation for another embodiment of the invention.
Figure 3D:
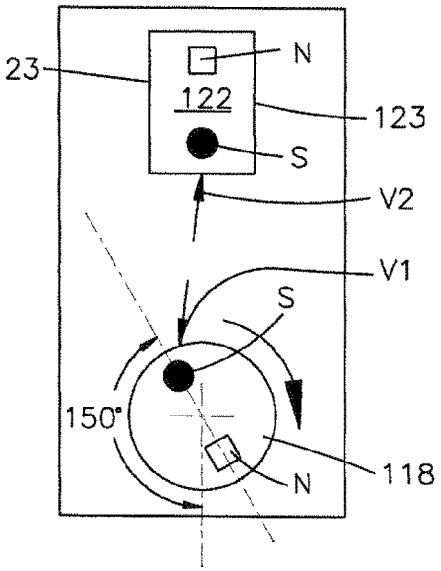

A more preferred embodiment for eliminating the need for a torsion spring is illustrated in FIG. 3D. In this more preferred embodiment the rotational motion of the drive magnet 118 is limited to less than 180 degrees, for example 150 degrees, as illustrated in FIG. 3D. This will negate the need to use a torsion spring or to reverse the polarity of motor voltage to drive carriage 123 and the driven magnet 122, back to the BDC position to open the valve. This is best explained by examining the reactive forces between the drive and driven magnets as shown in FIGS. 3C and 3D. As seen in FIG. 3C, when the drive magnet 118 is rotated 180 degrees, the driven magnet 122 moved into the TDC position and the valve is closed, there exists opposing magnetic forces between the magnets because the like south poles (S) in the respective drive and driven magnets are in closest proximity to each other. These opposing magnetic forces are represented as vectors V1 and V2 in FIG. 3C. V1 and V2 are applied coaxially with the respective polar axes of drive magnet 118 and driven magnet 122.

In FIG. 3D, the driven magnet motion is shown limited to 150 degree rotation. In this case magnetic forces represented by vectors V1 and V2 no longer act coaxially with respective polar axes of the drive or driven magnets. The vector V1 acting on the drive magnet 118 is statically balanced with the torsional force applied indirectly by energized motor 116 and transmitted through shaft 120 and the drive magnet caddy 119. The vector V2 acting on driven magnet 122 is statically balanced indirectly with reaction forces afforded by cylinder walls 132 and the interaction of seal 114 pressing against orifice 112.

However, upon removing voltage or de-energizing motor 116, the opposing force V1 acting on drive magnet 118 is no longer balanced by the applied motor torque, thus causing an imbalance of forces. This force imbalance causes a reversing (counterclockwise) rotation that backdrives motor 116, shaft 120, caddy 119 and drive magnet 118. The reverse rotation continues until the north pole (N) of the drive magnet 118 and the south pole (S) of the driven magnet 122 are moved into closest proximal positions as shown in FIG. 3B in connection with the drive and driven magnets 18, 22. In this position the forces represented by vectors V1 and V2 are now attractive forces acting respectively on the drive and driven magnets. V1 and V2 are now aligned coaxially with the polar axes of the respective magnets and the magnets are in a state of static balance. Accordingly valve assembly 110*a* may be moved from an open to closed state by energizing motor 116. Likewise, the valve assembly may be moved from a closed to open state by simply de-energizing motor 116 as long as the driven magnet motion is limited to less than 180 degrees rotation as shown in FIG. 3D.

Yet another embodiment of the present invention is its adaptation as a linear actuator. This embodiment directs the linear motion of the piston carriage assembly 123 into any useful function. The motion of piston carriage assembly 123 may be directed through a forward stroke motion by energizing motor 116, and a reverse stroke motion by de-energizing motor 116, in a manner similar to the motion described for the shut-off valve embodiment shown in FIGS. 8 and 9. Referring to FIG. 8, an actuating piston head may be defined as the valve head 110*a* with select elements removed including orifice 112 and seal 114. The linear motion of upper carriage or piston portion 124*a* may be used to drive a linear motion pump, actuate the opening or closing of a valve, or to provide for any other useful linear actuation purpose.

Many other applications of the magnet drive system principle are envisioned. It is not the intent of this disclosure to list all possible applications. The motor powered magnet drive system disclosed herein as an integral part of the disclosed pumping system may be applied wherever the motion of the piston may provide a useful outcome.

Magnet Pump Principle Used in Ratio Control Applications

While not limited to one industry, the beverage industry in particular has a long standing need to provide precise ratio of liquid constituents, specifically the volumetric ratio of water-to-beverage concentrate components. The post-mix beverage dispensing process is applied in the vast majority of fountain beverage systems. Post-mix is the process of blending 2 or more beverage components on demand. The beverage components—usually water and flavoring syrup (beverage concentrate)—are dispensed through post-mix beverage valves mounted on a fountain beverage dispensing tower. Mixing the beverage components at the point of dispense provides freshest mixed drink possible. The water and syrup are chilled to ice cold temperature before entering the valve. The water may be carbonated as in the case of soft drinks, or it may be non-carbonated as in the case of fruit juice or tea beverages. The flow rate of beverage dispensed through post-mix valves typically ranges between 3 and 6 volumetric ounces per second.

The water-to-syrup volume ratio is a critical element to obtain a quality tasting drink. Post-mix beverage valves generally use independent flow control mechanisms, one for water and one for syrup, in order to meter the syrup and water, and thereby control the dispensed beverage flow rate and the water-to-syrup volume ratio. While there are many different approaches to flow control, the most traditional approach is to employ a relatively economical pressure compensating piston-sleeve-spring flow control mechanism. Other flow control methods may include electronic means to measure the flow rate of water and/or syrup components and then apply proportional feedback control to an electromechanical valve or metering device to achieve the specified flow rate. Electronic controls provide increased flow accuracy. However the cost of the beverage valve may increase 2 to 3 times the cost of a valve that uses the traditional piston-sleeve-spring flow control mechanism.

The purpose of the flow control, regardless of its method of operation, is to maintain specified flow, even as upstream supply pressure to the beverage valve varies over a wide range. For example non-carbonated water pressures often vary between 30 to 70 psig. Carbonated water pressure is generally more reliable due to constant pressure maintained in the upstream carbonator. However, even carbonated water pressure can drop precipitously should 2 or more beverage valves operate simultaneously and cause high pressure drop in the supply tubes connecting the carbonator to the beverage valves.

Syrup is usually pumped using pressurized $CO_2$ gas driven diaphragm pumps. Diaphragm pumps discharge the syrup at pressures set to approximately 60 psig. However instantaneous pressures experienced in the diaphragm pump cycle may vary an additional 20 psig above and below the 60 psig set point. In many applications pumps are installed a very long distance from the beverage dispensing tower in the remote "backroom" (up to 100 feet away). Sometimes the backroom is located in a basement up to 30 feet below the dispensing tower. Variability in both horizontal and vertical (elevation) distance between the pump and the tower can result in variable pressure loss and variable pressure delivered to the dispensing valve. Sometimes the syrup pumps are mounted very close to the dispensing valves, just a few feet away under the counter. In such applications the upstream instantaneous pressure fluctuations presented by the diaphragm pump cannot be fully compensated for by the flow control, and resultant pulses in syrup flow are observed as varying color streams in the dispensed beverage.

Another variable that affects how well the flow control operates is the viscosity of the syrup which may fluctuate depending on its temperature and formulation. Chilled sugared syrups are highly viscous with the consistency of molasses. Artificially sweetened diet syrups flow very easily and with the viscosity near that of water. Room temperature syrups flow more easily than chilled syrups.

Unfortunately, due to the wide range of water and syrup conditions experienced, the traditional piston-sleeve-spring flow control mechanism is not able to maintain specified flow rate and ratio without frequent manual adjustments to or calibration of the flow control. Each post-mix dispensing valve must be adjusted during the initial installation to obtain the specified water-to-syrup volume ratio. The installation of a single beverage system can require initial calibration of as many as 24 dispensing valves. The valve calibration time is considered significant to the installation cost of the fountain beverage system.

There are many millions of post-mix beverage valves installed today, the majority using piston-sleeve-spring flow controls. Unfortunately, the valves are not maintenance free. After the initial installation the valves may come out of adjustment and cause drinks to be dispensed with incorrect volume ratio and poor drink quality. Flow control adjustment is typically the largest category of service calls for fountain beverage systems and is a major cost to the operators of such systems.

The ratio pump of this embodiment of the invention provides for fixed water-to-syrup volume ratio. The disclosed ratio pump is intended to replace conventional post-mix dispensing valves mounted on the beverage tower. In applications where there is not unreasonable restriction or vertical elevation between the syrup supply and the ratio pump, the ratio pump may also eliminate conventional, pressurized gas or electric motor driven syrup pumps that are remotely installed in the backroom. The ratio pump may fit the same or smaller footprint as a conventional post-mix dispensing valve. There is generally is no need to adjust the ratio either during the initial installation or during the operating life of the pump. The ratio of the pump is factory set, but may be changed to a new setting through very simple replacement of a modular pump head to be described.

The advantages are considerable and include elimination of cost to service the beverage dispensing system (associated with beverage valve maintenance and calibration), improved customer satisfaction through improved dispensed drink quality (ratio control) and reduced installation and capital equipment of the beverage dispensing system.

Figure 10:
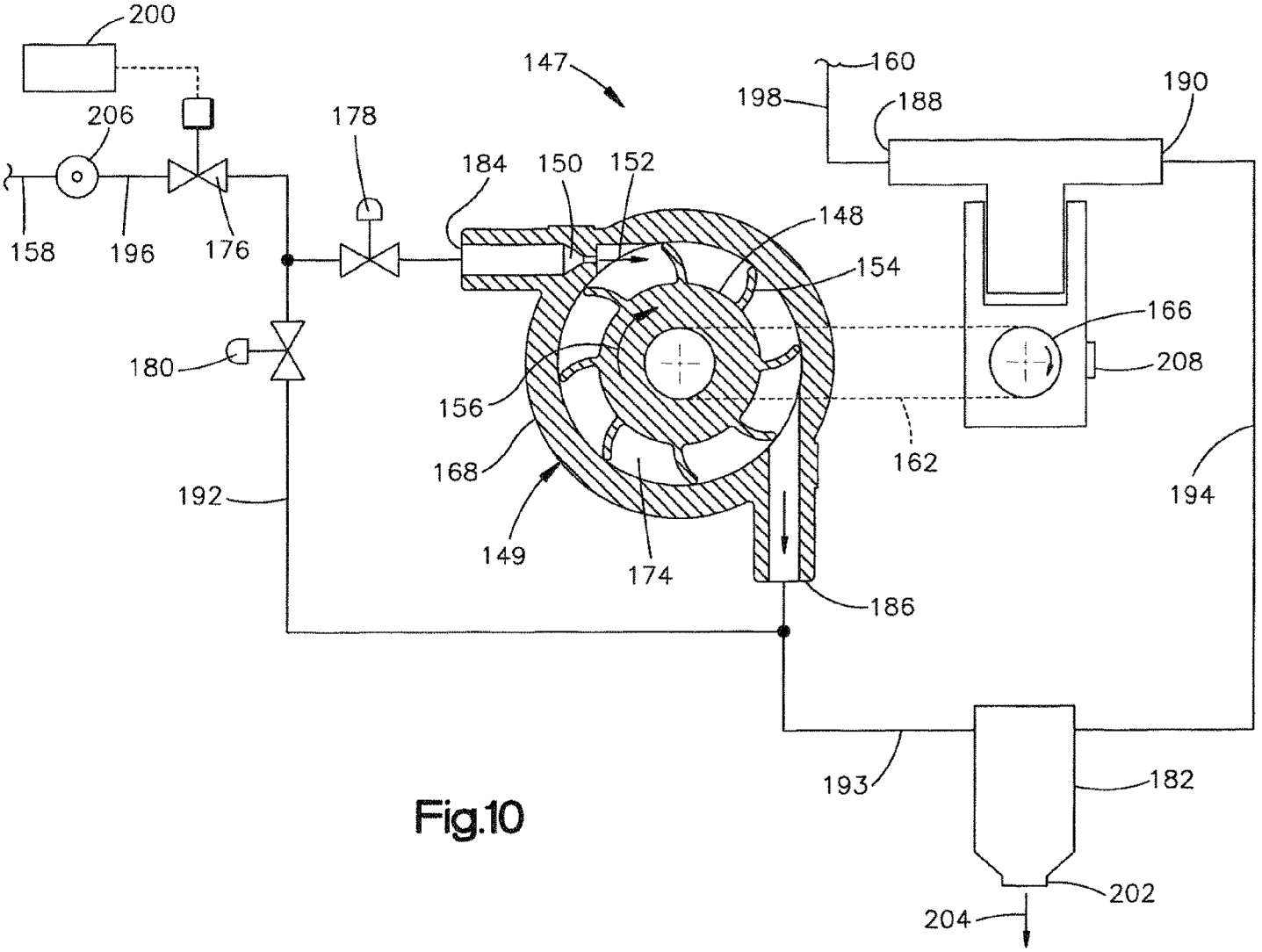
FIG. 10 is a schematic representation of a ratio pump and associated system components constructed in accordance with another embodiment of the invention.

FIG. 10 shows a process schematic of the ratio pump control system including a ratio pump 147. The disclosed ratio pump 147 requires availability of a pressurized water supply 158, and a non-pressurized beverage concentrate or syrup supply 160. The ratio pump employs the pressure of the incoming water to provide the energy source to pump the syrup. Hydraulic energy in the flowing, pressurized water stream is converted into mechanical energy using a water turbine assembly 149. Pressurized water presented to turbine inlet 184 is controlled by means of a conventional solenoid actuated valve 176 that activates to an open or closed position. Valve 176 opens in response to an operator input such as pressing a push button or a lever that in turn results in closure of an electrical switch. Requisite electronic controls and operator interfaces are collectively represented as control module 200. The control module 200, supplies solenoid valve 176 with voltage to activate the valve open. Upon opening of valve 176, water flows from pressurized source 158 through water supply lines 196 and through valve 176 into water turbine inlet 184.

Before engaging the turbine wheel 148, the incoming water is accelerated to high velocity by directing the water through an appropriately sized flow restrictor 150 with reduced flow area. Flow restrictor 150 may be configured as an orifice or nozzle to cause development of a high velocity water jet 152 downstream of the restrictor. Accordingly the restrictor converts potential energy held in the lower velocity, pressurized water upstream of the flow restrictor into kinetic energy represented by the high velocity water jet 152 downstream of the restrictor. The high velocity water jet impinges on the vanes or paddles 154 of the turbine wheel 148. Resultant deceleration of the water jet causes a transfer of momentum from the water jet to the turbine paddles and thus the development of a normal force that acts on the turbine paddles causing the turbine wheel to rotate in direction 156.

Figure 11A:
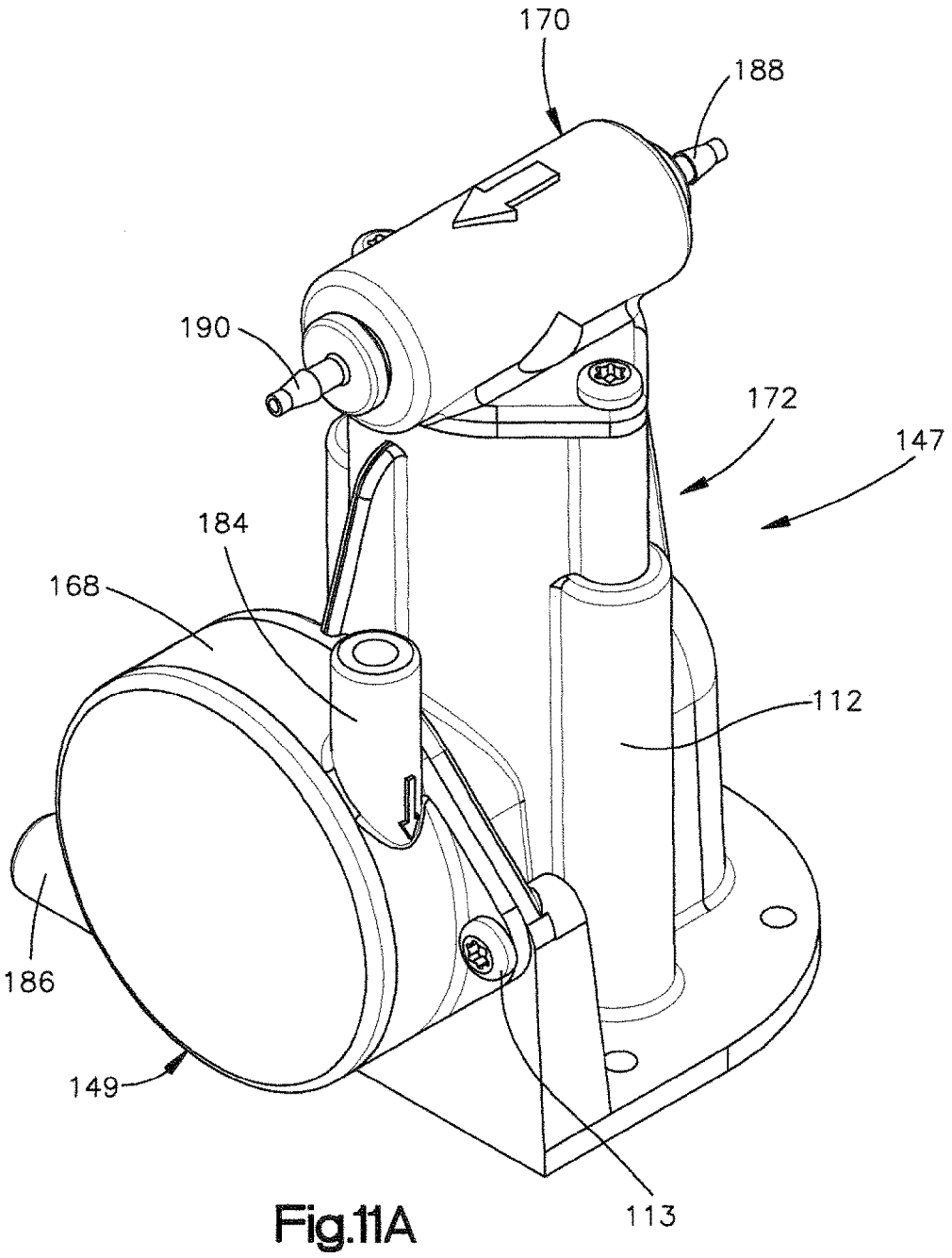
FIG. 11A is a perspective view of the ratio pump shown in FIG. 10.
Figure 11C:
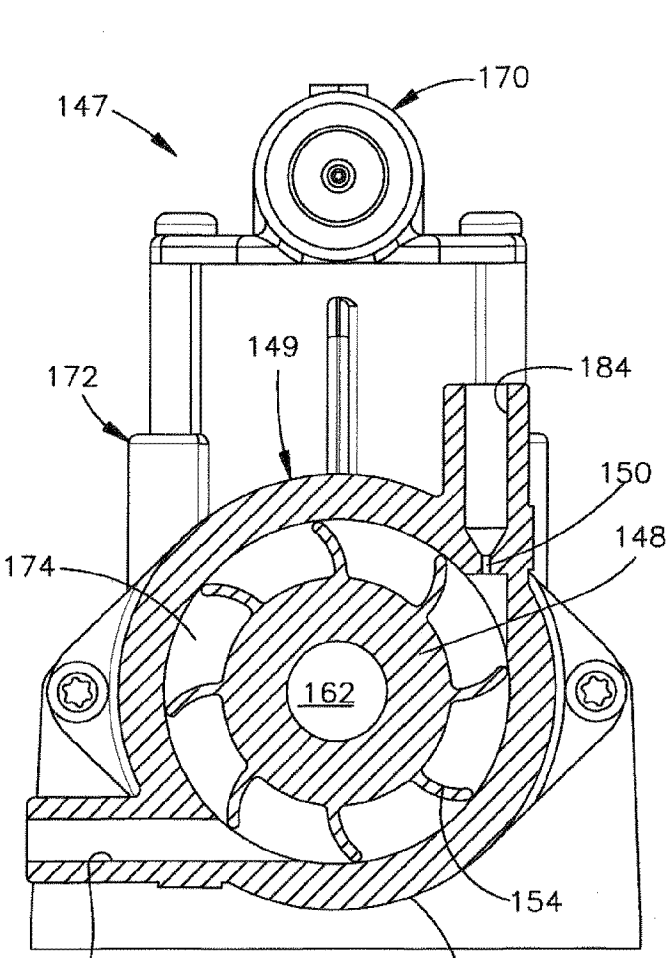
FIG. 11C is another sectional view of the pump shown in FIG. 11A, as seen from the plane indicate by the line 11C-11C, in FIG. 11B.
Figure 11B:
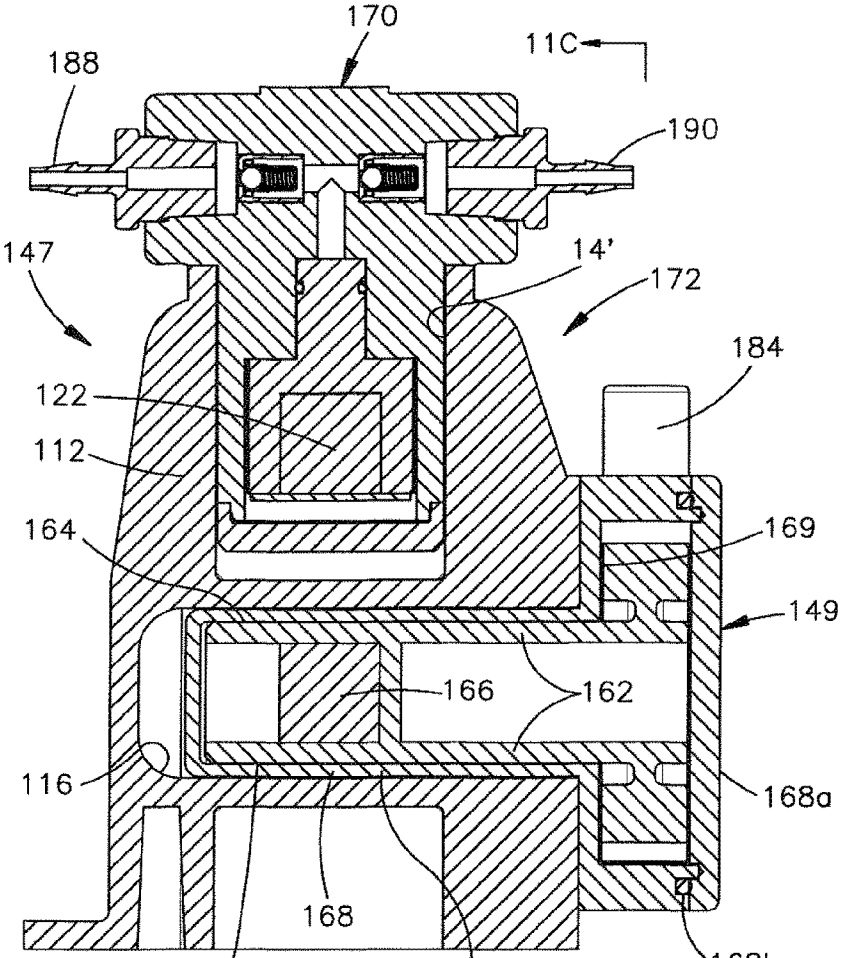
FIG. 11B is a sectional view of the ratio pump shown in FIG. 11A.

FIG. 11A-11C shows a physical rendering of the core components of the ratio pump system 147 including turbine wheel sub-assembly 149 and pump head sub-assembly 170. For ease of presentation components such as the valve 176, the bypass line 192 or dispensing nozzle 202 are not rendered in FIGS. 11A-11C, as these components are more easily presented for understanding in the process schematic shown in FIG. 10. The axle 162 of the water turbine wheel comprises a hollow shaft that extends from preferably one side of the turbine wheel. The hollow shaft is supported by a close fitting cylindrical pocket (or bushing) 164 formed as part of a close fitting enclosure 168 that hermetically encases the turbine wheel. A radial magnetized, bi-polar, permanent drive magnet 166 is affixed inside the extended, hollow axle and inside the wetted zone of the water turbine. The inlet orifice 150, turbine wheel 148 including shaft 162, and with hermetically sealed enclosure 168 comprise a self-contained water turbine sub-assembly. The entire turbine assembly is accepted into hollow cylindrical pocket 116 and secured to housing 112 by means of fasteners 113. The assembled combination of turbine sub-assembly 149 with housing 112 and fasteners 113 comprises drive module sub-assembly 172. The drive magnet 166 rotates in unison with the turbine wheel at the same rotational speed. A modular pump head 170 is affixed to a drive module 172 and positioned in close proximity to the drive magnet such that there is sufficient magnetic field strength to cause the drive magnet to engage the driven magnet (122) assembled inside pump head 170, in cyclic linear motion as the turbine wheel rotates about the axle supported by said bushings. The modular pump head is mounted exterior to and is completely separated from the wetted turbine wheel components. The turbine wheel rotation is synchronous with the rotation of the drive magnet and the stroke rate of the pump head. Accordingly there is a fixed, synchronous relationship between the rotation speed of the turbine wheel and the cyclic stroke rate of the pump.

Paddles 154 of the turbine wheel are preferentially evenly spaced around the circumference of the wheel. "Water buckets" 174 of fixed volume are formed by the interior surfaces of adjacent paddles and the interior side walls 169 of the hermetic enclosure 168. As water impinges on a first paddle the wheel rotates forward and the paddle advances away from the water jet until it is no longer exposed to the jet. At this point a next successive second paddle becomes exposed to the water jet. The advancing water bucket formed between the first and second paddles is filled with water that has fully decelerated, transferred its momentum to the turbine wheel, and created the force required to rotate the wheel. As long as the clearances between the paddles and the turbine enclosure are sufficiently small, water entering the turbine must advance to the turbine discharge 186 by the forward rotational movement of successive buckets filled with water. Accordingly a proportional relationship exists between the angular rotation of the turbine wheel and the volume of water processed by the turbine wheel. By proportional association and factoring the synchronous relationship between the turbine wheel and the pump head sub-assembly, a fixed proportional relationship (or ratio) also develops between the volume of syrup pumped by modular pump head 170 and the volume of water flowing through the turbine wheel.

Referring to FIG. 10, beverage concentrate or syrup supply 160 is connected to the inlet port 188 of the pump head by syrup supply line 198. Discharge port 190 of the pump head connects to discharge passage 194 which in turn feeds mixing chamber 182, the outlet of which is connected to dispensing nozzle 202. Discharge port 186 of turbine sub-assembly 149 connects with water discharge passage 193 which also feeds to chamber 182. The delivery of water and syrup to chamber 182 is accordingly provided in a fixed volume relationship. Upon mixing of the water and syrup components in chamber 182 the beverage product 204 is dispensed through nozzle 202.

Water flow rate and flow rate of dispensed product 204 will vary in proportion to changes in upstream water pressure presented to the ratio pump. Thus the rotation speed of the turbine wheel will lessen with lowered water pressure and increase with higher water pressure. However the change in water flow rate does not impact ratio because the volume of the syrup flow changes in the same proportion as changes in the turbine wheel speed and water flow rate.

The ratio pump being integrated with the modular magnet pump is effective for pumping high viscosity fluids such as sugared syrups. Increase in syrup viscosity (causing more frictional pressure drop) and/or increase in the lifting height (between the syrup supply and the ratio pump 147) require more pumping power. While increased pumping power increases load on the turbine wheel causing lower speed, a proportional reduction in both water and syrup flow rate maintains a constant water-to-syrup volume ratio of dispensed beverage.

The volumetric capacity (per stroke) of the pump head 170 in combination with the fixed physical geometry (or capacity) of the water turbine sets the volumetric ratio of the ratio pump 147. However, the water flow rate processed through the ratio pump will vary with the upstream water pressure presented to the ratio pump, as will the dispensed beverage flow rate. During the initial installation the operator may want the flexibility to adjust the dispensed beverage flow rate higher or lower depending on the available water supply pressure. Referring to FIG. 10, the flow rate of the ratio pump may be varied through a manually adjustable flow restriction valve 178 placed upstream of the fixed restriction 150. The adjustable flow restriction valve 178 effectively increases or decreases water pressure presented to the ratio pump at turbine inlet port 184. Accordingly, flow rate may be increased or decreased by respectively opening or closing the adjustable flow restriction valve 178.

The primary strategy of the ratio pump 147 is to set a fixed ratio according to selection of the volumetric capacity of the modular pump head 170 and the size of the water turbine wheel 148. In some applications it may not be practical to offer standard capacity modular pump heads for all conceivable ratio settings required for different beverages, and it may be necessary to fine tune the ratio of a given pump head 170. Referring to FIG. 10, the ratio can be adjusted by introduction of a fluid passage 192 that bypasses water around the turbine assembly 148. A manually adjustable flow restriction valve 180 is positioned in bypass fluid passage 192. Closing bypass flow restriction valve 180, causes less water to bypass the turbine assembly, and thus decreases the water-to-syrup volume ratio. Opening bypass flow restriction 180, causes more water to bypass the turbine, and thus increases the water-to-syrup volume ratio.

Low water pressure in the non-carbonated water supply is a major problem when traditional piston-sleeve-spring flow controls are used. Water pressure in non-carbonated systems is highly variable and less reliable as compared to carbonated water systems, wherein relatively constant head pressure is maintained by the carbonator. So called "ambient" and "cold" carbonations systems generally maintain stable carbonated water supply pressures of 110 psig and 70 psig, respectively.

Traditional flow controls lose virtually all ability to regulate water flow at pressures below 35 psig and the delivered water flow rate can fall precipitously. The standard industry recommendation in this case is to install an expensive water pressure booster upstream of water supply 158 to regulate the pressure to a level above 35 psig, and preferably in the range of 60 to 70 psig.

When applied in non-carbonated water systems that experience very low water pressure, the ratio pump may offer a special advantage and negate installation of an expensive water pressure booster. A relatively low cost water pressure regulator 206 may be installed upstream of the ratio pump between supply 158 and inlet solenoid valve 176. It may be possible to set the regulator and the ratio pump to operate at a very low pressure, for example as low as 10 psig at turbine inlet 184. The theoretical pressure drop across the turbine wheel is on the order of 5 psig based on the hydraulic energy (flow rate×pressure rise) required to pump the syrup in a typical application. Thus 10 psig is theoretically or ideally enough water pressure to drive the turbine wheel and pump the syrup. Even as the water pressure upstream of the regulator may vary from as high as 100+ psig to as low as 10 psig, the pressure regulator will present a constant pressure of 10 psig to inlet 184 (of course factoring any pressure drop across valves 176 and 178), while maintaining constant flow rate of delivered beverage and constant water-to-syrup volume ratio. The adjustable inlet restriction 178 must be opened to provide a very low level of restriction to achieve the desired beverage flow rate because the inlet pressure is set so low. If the beverage flow rate is still too low, then the regulator 106 can be set to a pressure higher than 10 psig as may be necessary to achieve the required beverage flow.

This same water regulating approach may be applied in carbonated systems if there is concern with the stability of the carbonator head pressures. In summary, the ratio pump may be applied to deliver constant water flow through the use of an upstream pressure regulator set at suitably low pressure. This allows the ratio pump to operate over a wide range of system water pressures with a constant flow rate. In non carbonated systems application of the ratio pump may negate the use of an expensive water pressure booster.

The control Module 200 may be physically integrated with the ratio pump 147 or remotely positioned away from the ratio pump. A Hall Effect Sensor 208 may be adapted to the ratio pump to optionally sense the magnetic field of drive magnet 166 and/or of the driven magnet 122 contained inside the pump head 170. The signal generated from the Hall Effect Sensor provides a mechanism for the control module 200 to count pump strokes and accordingly calculate the volume of dispensed beverage. This provides the opportunity for the user to select a desired dispensed drink portion size (for example, small, medium, and large) using an interface such as a push button pad that is integrated with Control Module 200.

Optionally two Hall Effect Sensors may be concurrently applied, one to sense the drive magnet and the other to sense the driven magnet. This way the control module 200 may discern a malfunction of the pump head if the counts developed from each sensor do not match. In this case the control module may develop an override to stop the dispensing function and/or develop an Alarm Condition to indicate there is a malfunction.

The control module 200 may also be optionally connected to an external data network to transmit information such as number of drinks dispensed, portion size, time of day dispensed, alarm condition, etc. that may be useful to the store owners and/or beverage concentrate suppliers.

The disclosed ratio pump and system integrates the syrup pumping function with the dispensing function. The ratio pump concurrently pumps the syrup from remote location while also metering the syrup and water in pre-set ratio. The elimination of conventional syrup pumps greatly reduces the complexity of the fountain beverage system, and provides an opportunity for large reduction in installed cost and annual maintenance costs, while reducing system complexity and increasing overall reliability.

The ratio pump has numerous advantages as compared to conventional post mix beverage valve technology. The ratio pump provides for proportional changes in water flow rate, turbine wheel speed and magnet pump stroke rate. Accordingly water-to-beverage concentrate ratio is held constant even as the water flow rate changes due to variable water pressure. Pump volumetric flow per stroke is constant, and is impervious to changes in viscosity caused by temperature variability or by changes in syrup composition (diet vs. sugared syrups). The ratio pump may replace the function of expensive "backroom" beverage concentrate pumps. The energy required to pump the concentrate is derived from the water turbine which converts water pressure to useful pumping energy. The ratio pump head 170 is modular and quickly replaced.

This feature provides a great degree of operational flexibility to accommodate changeover to beverages with different mix ratios and/or to replace a broken pump head. Maintenance cost to periodically adjust the flow controls of conventional post-mix vales is greatly reduced.

The disclosed ratio pump provides improved portion control technology. A Hall Effect sensor can be added to the pump body to allow for electronic counting of magnetic piston strokes. Integrated with a "smart" electronic control module, the volume of syrup and water dispensed may be instantly calculated. Accordingly the user may select a custom portion size at the operator interface.

The potential for cost reduction using the disclosed ratio pump cannot be understated. Elimination of the syrup pumps also eliminates expensive carbon dioxide used to drive the pumps and associated tanks, hoses, fittings, pressure regulators, valves, etc. A single beverage installation may save thousands of dollars in installed cost. The improved reliability of the disclosed ratio pump may also save thousands of dollars in reduced maintenance cost over the life of the installation.

While this description is specifically oriented to application of the disclosed ratio pump for dispensing post mix beverage, it is not to be construed as limiting its application. The disclosed ratio pump may be applied in any application requiring the delivery of two fluid components in fixed proportion to one another, and when the first fluid component is presented at sufficient pressure and flow rate to provide the energy source to pump the second fluid.

Although the invention has been described with a certain degree of particularity, it should be understood that those skilled in the art can make various changes to it without departing from the spirit or scope of the invention as hereinafter claimed.

Having described the invention, the following is claimed:

1. A fluid pumping apparatus comprising:

a) a shaft which is operative to rotate at least one drive magnet, said drive magnet having magnetic poles oriented radially about said shaft;

b) at least one pump head including a driven magnet carried by a carriage, said carriage reciprocally, linearly movable in a pump head housing, said housing provided with an inlet port, an outlet port and associated inlet and outlet check valves;

c) a drive module housing, including structure for receiving said pump head and arranged such that said driven magnet is located in proximity to the drive magnet so as to create alternating attracting and repelling, radially directed forces between the drive and driven magnets as the drive magnet is rotated about the axis of said shaft; and, d) an air-bleed accumulator in fluid communication with said inlet port to said pump head, including a membrane operative to discharge air accumulated in an accumulator chamber forming part of said accumulator.

2. The fluid pumping apparatus of claim 1 wherein said shaft is operatively connected to an electric motor.

3. The fluid pumping apparatus of claim 1 wherein said shaft is operatively coupled to a fluid driven turbine.

4. The fluid pumping apparatus of claim 3 wherein said shaft comprises an axle of said fluid driven turbine.

5. The fluid pumping apparatus of claim 4 wherein said drive magnet and said axle are integrally mounted and fully enclosed by said drive module housing.

6. The fluid pumping apparatus of claim 1 wherein only one pump head is associated with said drive magnet.

7. The apparatus of claim 1 wherein said pumping head forms part of a pump assembly.

8. The pump apparatus of claim 7 wherein said pump assembly functions as a ratio pump and forms part of a system for portionally mixing at least two fluids.

9. The apparatus of claim 8 wherein said two fluids comprise a beverage syrup and water.

10. The apparatus of claim 9 wherein the water is carbonated.

11. The apparatus of claim 1 wherein said air bleed accumulator includes a check valve operative along with said membrane to discharge air accumulated in said accumulator chamber and to inhibit back flow of air into said chamber when pressure in the chamber is less than atmospheric pressure.

12. A control valve apparatus comprising:

a) a shaft which is operative to rotate at least one drive magnet, said drive magnet having magnetic poles oriented radially about said shaft;

b) at least one valve head including a driven magnet carried by a carriage, said carriage reciprocally, linearly movable in a valve housing, said housing provided with an inlet port, an outlet port and a passage in fluid communication with said inlet and outlet ports;

c) a drive module housing, including structure for receiving said valve head and arranged such that said driven magnet is located in proximity to the drive magnet so as to create alternating attracting and repelling, radially directed forces between the drive and driven magnets as the drive magnet is rotated about the axis of said shaft;

d) a valve seal carried by said carriage and movable towards and away from an associated valve orifice, whereby fluid flow through said passage is controlled, and, c) mechanical stops for limiting the rotation of said shaft, whereby rotative movement in said drive magnet is less than 360°.

13. The control valve apparatus of claim 12 wherein said rotative movement is limited to less than 180°.

14. The control valve apparatus of claim 13 wherein said rotative movement is limited to substantially 150°.

15. The control valve apparatus of claim 12 wherein a torsion spring is mechanically coupled with said shaft to return the drive magnet to a start position when an associated drive actuator or motor is de-energized.

* * * * *